US005206611A

United States Patent [19]

Russell

[11] Patent Number: 5,206,611

[45] Date of Patent: Apr. 27, 1993

[54] N-WAY MICROWAVE POWER DIVIDER

[75] Inventor: Thomas J. Russell, Sunnyvale, Calif.

[73] Assignee: Krytar, Inc., Sunnyvale, Calif.

[21] Appl. No.: 853,410

[22] Filed: Mar. 12, 1992

[51] Int. Cl.[5] ..... H01P 5/12

[52] U.S. Cl. ..... 333/127; 333/128; 333/238

[58] Field of Search ..... 333/127, 128, 124, 125, 333/130, 246, 238, 136, 204, 100, 126, 34

[56] References Cited

U.S. PATENT DOCUMENTS

| | | | |
|---|---|---|---|
| 3,091,743 | 5/1963 | Wilkinson | 333/9 |
| 3,103,638 | 9/1963 | Greuet | 333/9 |
| 3,516,024 | 6/1970 | Lange | 333/10 |
| 3,529,265 | 9/1970 | Podell | 333/127 X |
| 4,129,839 | 12/1978 | Galani et al. | 333/9 |
| 4,835,496 | 5/1989 | Schellenberg et al. | 333/128 |
| 4,885,557 | 12/1989 | Barczys | 333/124 |
| 4,945,321 | 7/1990 | Oppelt et al. | 333/119 |
| 4,968,958 | 11/1990 | Hoare | 333/128 |
| 5,025,233 | 8/1991 | Leonakis | 333/128 |
| 5,150,084 | 9/1992 | Asa et al. | 333/128 |

OTHER PUBLICATIONS

Cohn, "A Class of Broadband Three-Port TEM-Mode Hybrids", *IEEE Transactions on Microwave Theory and Techniques*, vol. MTT-16, No. 2, Feb. 1968, pp. 110-116.

Yee et al., "N-Way TEM-Mode Broad-Band Power Dividers", *IEEE Transactions on Microwave Theory and Techniques*, vol. MTT-18, No. 10, Oct. 1970, pp. 682-688.

Lange, "Interdigitated Stripline Quadrature Hybrid", *IEEE Transactions on Microwave Theory and Techniques*, vol. MTT-17, Dec. 1969, pp. 1150-1151.

Krage et al., "Characteristics of Coupled Microstrip Transmission Lines—I: Coupled Mode Formulation of Inhomogeneous Lines", *IEEE Transactions on Microwave Theory and Techniques*, vol. MTT-18, No. 4, Apr. 1970, pp. 217-222.

Amemiya, "Time Domain Analysis of Multiple Parallel Transmission Lines", *RCA Review*, vol. 28, Jun. 1967, pp. 241-276.

Tripathi, "Asymmetric Coupled Lines in an Inhomogeneous Medium"; *IEEE Transactions on Microwave Theory and Techniques*, vol. MTT-23, No. 9, Sep. 1975, pp. 734-739.

Tripathi, "Equivalent Circuits and Characteristics of Inhomogeneous Nonsymmetrical Coupled-line Two-port Circuits", *IEEE Transactions on Microwave Theory and Techniques*, vol. MTT-25 (Feb. 1977, pp. 140-142.

(List continued on next page.)

*Primary Examiner*—Steven Mottola
*Assistant Examiner*—Ali Neyzari
*Attorney, Agent, or Firm*—Edward B. Anderson

[57] ABSTRACT

A power divider formed by the interconnection of an input resistive network and a transmission line network for dividing a signal received on an input port into N output ports. Four embodiments are described. Three are two-way power dividers and one is a three-way power divider. A 2-way equal division power divider comprises an outer conductor 51 which has a generally rectangular cross section and is filled with a lower dielectric sheet, a center dielectric sheet and an upper dielectric sheet. The dielectric sheets are made of low loss material. Inner conductors are photo-etched from a conducting material that has been deposited or laminated to both surfaces of the center dielectric sheet. Two conductors are spaced a maximum distance from each other at their outputs and are in close proximity to each other at their inputs. Two resistors are connected respectively from the conductor inputs to a power divider input. Another form of two-way equal division power divider, a two-way unequal division power divider, and a three-way equal division power divider are also described.

15 Claims, 21 Drawing Sheets

OTHER PUBLICATIONS

Speciale & Tripathi, "Wave Modes and Parameter Matrices of Non-symmetrical Coupled Lines in a Non-homogeneous Medium"; *Int. J. Electron,* vol. 40, No. 4, 1976, pp. 371-375.

Collin, "The Optimum Tapered Line Matching Section", *Proceedings of the IRE,* vol. 44, Apr. 1956, pp. 539-548.

Shelton, "Impedances of Offset Parallel-Coupled Strip Transmission Line", *IEEE Transactions on Microwave Theory and Techniques,* vol. MTT-14, Jan. 1966, pp. 7-15.

Oliver, "Directional Electromagnetic Couplers", *Proc. IRE,* vol. 42, Nov. 1954, pp. 1686-1692.

Levy & Cohn, "History of Passive Components with particular Attention to Directional Couplers", *IEEE Transactions on Microwave Theory and Techniques,* vol. MTT-32, Sep., 1984, pp. 1046-1054.

Young, "Tables of Cascaded Homogeneous Quarter-Wave Transformers", *IRE Transactions on microwave Theory and Techniques,* vol. MTT-7, Apr. 1959, pp. 233-237.

Green, "The Numerical Solution of Some Important Transmission-Line Problems", *IEEE Transactions on Microwave Theory and Techniques,* vol. MTT-13, Sep. 1965, pp. 676-692.

Parad et al., "Split-Tee Power Divider", *IEEE Transactions on Microwave Theory and Techniques,* Jan. 1965, pp. 91-95.

Goodman, "A wideband Stripline Matched Power Divider", 1968 Int. Microwave Symp. Dig., pp. 16-20.

Saleh, "Planar Electrically Symmetric n-Way Hybrid Power Divider/Combiners", *IEEE Transactions on Microwave Theory and Techniques,* vol. MTT-28, No. 6, Jun. 1980, pp. 555-563.

N-WAY MICROWAVE POWER DIVIDER

BACKGROUND OF THE INVENTION

1. Field of the Invention

This invention relates generally to broadband microwave power dividers suitable for distributing an input signal between a selected number of output loads.

2. Description of Prior Art

Microwave power dividers are useful in a wide variety of instrumentation and system applications, such as feeding signals to multiple antennas. Power dividers can also be used to combine microwave signals by applying the signals to be combined to what would normally be considered the outputs of the divider. Combining signals in this manner is a popular way of obtaining higher output power from semiconductor signal sources.

Thus, for ease of discussion, the invention is described as a power divider. As is commonly understood, the term also means power combiner, in which case the current direction is simply reversed, with each output functioning as an input and each input functioning as an output.

Early N-way power dividers with equal power division are described in U.S. Pat. No. 3,091,743 issued to Wilkinson; and 4,129,839 issued to Galani et al. These power dividers have the disadvantage of covering a relatively narrow frequency bandwidth—typically under 1.5:1. A two-way equal division power divider capable of greater bandwidth is described by Cohn in "A Class of Broadband Three-Port TEM-Mode Hybrids," *IEEE Transactions on Microwave Theory and Techniques*, vol. MTT-16, no. 2, February 1968, pp. 110–116. A schematic diagram of the power divider described by Cohn is shown in FIG. 1. Most of the commercially available broadband two-way equal division power dividers are made according to Cohn's design. An extension of the Cohn design to an N-way equal division power divider is described by Yee et al. in "N-Way TEM-Mode Broad-Band Power Dividers," *IEEE Transactions on Microwave Theory and Techniques*, vol. MTT-18, no. 10, October 1970, pp. 682–688. A schematic diagram of the power divider described by Yee et al. is shown in FIG. 2. The devices of Cohn and Yee et al. both obtain increased bandwidth by using cascaded equal length transmission-line segments with interconnecting resistors.

Both of these devices have a band pass type of frequency response and have the disadvantage of having the frequency range limited by the pass band. Another serious disadvantage is that, for a wide bandwidth, a large number of resistors are required. Another disadvantage of these devices is that they require interconnecting resistors with values that are relatively high with respect to the $Z_o$ characteristic impedance of their input and output ports. For example, a 10:1 bandwidth 2-way equal division power divider described by Cohn uses (assuming 50 ohms input and output impedances) 7 resistors varying in value from 129.6 to 616.1 ohms. These high values of resistances typically have parasitic reactances that significantly degrade performance at higher (above 10 GHz) microwave frequencies. The Yee et al. device requires similar high resistance values.

Conventional power dividers require relatively large numbers of resistors. For example the 10:1 bandwidth, 2-way equal division power divider described by Cohn uses 7 transmission line segments and 7 resistors. A 2:1 bandwidth, 3-way equal division power according to Yee et al. would typically require 6 resistors. It is desirable to construct power dividers in microstrip. Microstrip is desirable because of relatively low cost and compatibility with integration into microstrip systems. A widely used microstrip device that gives equal power division and outputs 90° apart is described by Lange in the paper "Interdigitated Stripline Quadrature Hybrid, " *IEEE Transactions on Microwave Theory and Techniques*, vol. MTT-17, December 1969, pp. 1150–1151. The Lange device typically has poor isolation above 25 GHz because of discontinuities introduced by bond wires and abrupt junctions at the ends of the coupled lines.

SUMMARY OF THE INVENTION

The present invention overcomes the limitation of these known devices. Two of the preferred embodiments of this invention have a high pass frequency response-providing for coverage of a much greater frequency range.

Further, the present invention uses relatively few resistors. The 2 -way equal division power divider according to a preferred embodiment of this invention uses only 2 resistors and covers much greater frequency range. The 60% bandwidth 3-way equal division power divider according to another preferred embodiment of this invention uses only 3 resistors.

Equal way power dividers according to the present invention use resistors that have values typically smaller than $Z_o$ and are less affected by parasitic reactances.

The present invention also provides for unequal power division in a N-way power divider.

A 2-way equal division power divider according to the invention has an approximately 55 percent bandwidth and performs well above 25 GHz and is realized in microstrip. Further, this power divider can be modified simply to provide outputs that are 90° apart in phase.

More specifically, the present invention provides an N-way unequal, or equal, power divider comprising an input network and a transmission line network that functions contrary to conventional theory. The input network includes N signal paths from its input to N interconnection ports that are connected to N interconnection ports of the transmission line network. The input network also includes at least N-1 resistors that have at least one end connected to a different interconnection port. The transmission line network has N transmission lines that are significantly coupled together at the transmission line network inputs and connected at their opposite ends to the transmission line network output ports. The transmission line network matches the divider output port impedances to the output impedances of respective ports of the input network in a manner to provide that all output ports of the divider are matched and isolated from each other.

These and other features of the invention are described with reference to four preferred embodiments described below and illustrated in the accompanying drawings.

BRIEF DESCRIPTION OF THE DRAWINGS

FIG. 6 is a partial cross section taken along line 6—6 in FIG. 5.

FIG. 36 is a schematic of the embodiment of FIGS. 32-35.

DESCRIPTION OF THE PREFERRED EMBODIMENTS

Figure 1:
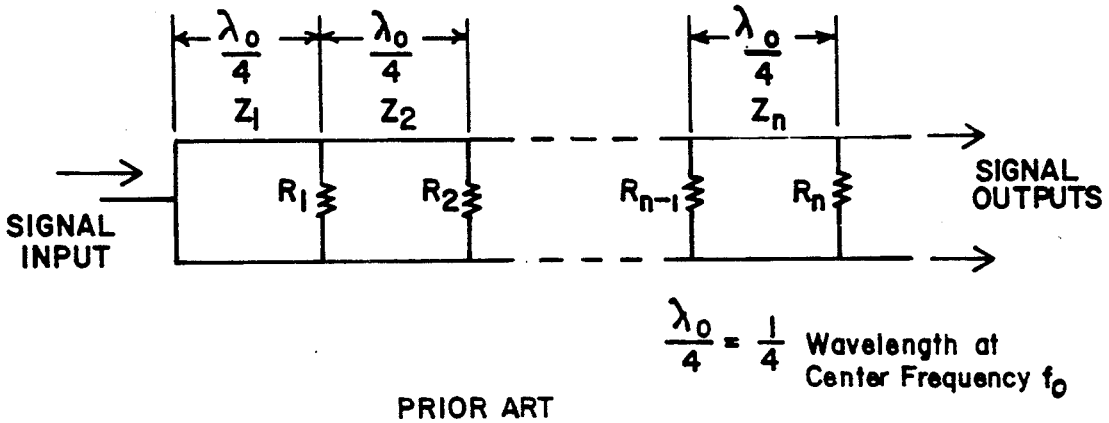
PRIOR ART Fig 1
FIG. 1 is a schematic diagram of a conventional power divider described by Cohn.

The detailed description of the invention includes a description of the related theory, followed by a description of four embodiments of the invention.

Theory Related to N Coupled Transmission Lines

It is assumed here that propagation in the transmission line network is TEM mode (homogeneous dielectric) or quasi-TEM mode (inhomogeneous dielectric) with quasi-TEM mode propagation as defined by Krage et al. in "Characteristics of Coupled Microstrip Transmission Lines-I: Coupled Mode Formulation of Inhomogeneous Lines, *IEEE Transactions on Microwave Theory and Techniques*, vol. MTT-18, no. 4, April 1970, pp. 217-222.

Electrical characteristics of a uniform length of n parallel coupled quasi-TEM mode transmission lines are uniquely determined by the length, and the [L] and [C] matrices defined below $$[L] = \begin{bmatrix} L_{11} & L_{12} & L_{13} & \dots & L_{1n} \\ L_{21} & L_{22} & L_{23} & \dots & L_{2n} \\ L_{31} & L_{32} & L_{33} & \dots & L_{3n} \\ . & . & . & \dots & . \\ . & . & . & \dots & . \\ . & . & . & \dots & . \\ L_{n1} & L_{n2} & L_{n3} & \dots & L_{nn} \end{bmatrix} \quad (1)$$

where $L_{ii}$=Self inductance per unit length of line i, i=1,2,3, . . . ,n.

$L_{ij}$=Mutual inductance per unit length between line i and line j, i≠j and i,j=1,2,3, . . . ,n.

$$[C] = \begin{bmatrix} C_{11} & -C_{12} & -C_{13} & \dots & -C_{1n} \\ -C_{21} & C_{22} & -C_{23} & \dots & -C_{2n} \\ -C_{31} & -C_{32} & C_{33} & \dots & -C_{3n} \\ . & . & . & \dots & . \\ . & . & . & \dots & . \\ . & . & . & \dots & . \\ -C_{n1} & -C_{n2} & -C_{n3} & \dots & C_{nn} \end{bmatrix} \quad (2)$$

where $$C_{ii} = C_{io} + \sum_{j-1}^{n} C_{ij}$$

$C_{io}$=Capacitance per unit length between line i and ground, i=1, 2, 3, . . ., n;

$C_{ij}$=Capacitance per unit length between line i and line j, i≠j and i, j=1, 2, 3, . . ., n; and $C_{ij}=C_{ji}$, i,j=1, 2, 3, . . ., n.

The [L] and [C] matrices are uniquely determined by the dielectric composition and dimensions of the cross section of the parallel coupled lines.

The inductive and capacitive coupling coefficients $K_L$ and $K_C$ between two lines i and j are given by $$K_L = \frac{L_{ij}}{\sqrt{L_{ii}L_{jj}}} \quad (3)$$

and $$K_c = \frac{C_{ij}}{\sqrt{C_{ii}C_{jj}}} \quad (4)$$

Electrical characteristics of a uniform length of n parallel TEM mode transmission lines are uniquely determined by the length and the [C] matrix of equation 2, since for TEM mode transmission $$[L] = \frac{1}{v^2}[C]^{-1} \quad (5)$$

where v is the velocity of propagation in the medium.

Also, for TEM mode transmission $K_L=K_C$.

If a uniform length of transmission line is terminated with its characteristic impedance, it is well known that no signals propagating toward the termination will be reflected. In an analogous manner there exists for N parallel coupled transmission lines a matched termination network such that, when the transmission lines are terminated with said network, no signals propagating toward the network on any of the transmission lines will be reflected. The existence and realizability of and equations relating to such a network are discussed in detail by Amemiya in "Time Domain Analysis of Multiple Parallel Transmission Lines," *RCA Review*, vol. 28, June 1967, pp. 241–276. It is assumed here that the transmission lines we are dealing with are low loss and, as is well known in the art, lossless analysis techniques will give good accuracy.

It will be convenient for us to define the matched termination network in terms of a conductance matrix [G]. For quasi-TEM mode propagation it has been shown by Amemiya that $$[G] = [C][V]_m[v][V]_m^{-1} \quad (6)$$

where $$[v] = \begin{bmatrix} v_1 & 0 & 0 & \dots & 0 \\ 0 & v_2 & 0 & \dots & 0 \\ 0 & 0 & v_3 & \dots & 0 \\ . & . & . & \dots & . \\ . & . & . & \dots & . \\ . & . & . & \dots & . \\ 0 & 0 & 0 & \dots & v_n \end{bmatrix} \quad (7)$$

with $v_i$=velocity of propagation of the ith mode, $v_i=1/\sqrt{\delta_i}$ where the $\delta_i$ are eigenvalues of [L][C], and $[V]_m$ is a modal matrix made of n different eigenvectors of [L][C]. For TEM mode propagation equation 6 reduces to $$[G]=v\,[C] \quad (8)$$

where v is the velocity of propagation in the medium.

Theory Related to Two Asymmetric Coupled Lossless Transmission Lines in an Inhomogeneous Dielectric Tripathi has shown in the paper "Asymmetric Coupled Lines in an Inhomogeneous Medium," *IEEE Transactions on Microwave Theory and Techniques*, vol. MTT-23, no. 9, September 1975, pp. 734–739, the following.

Figure 3:
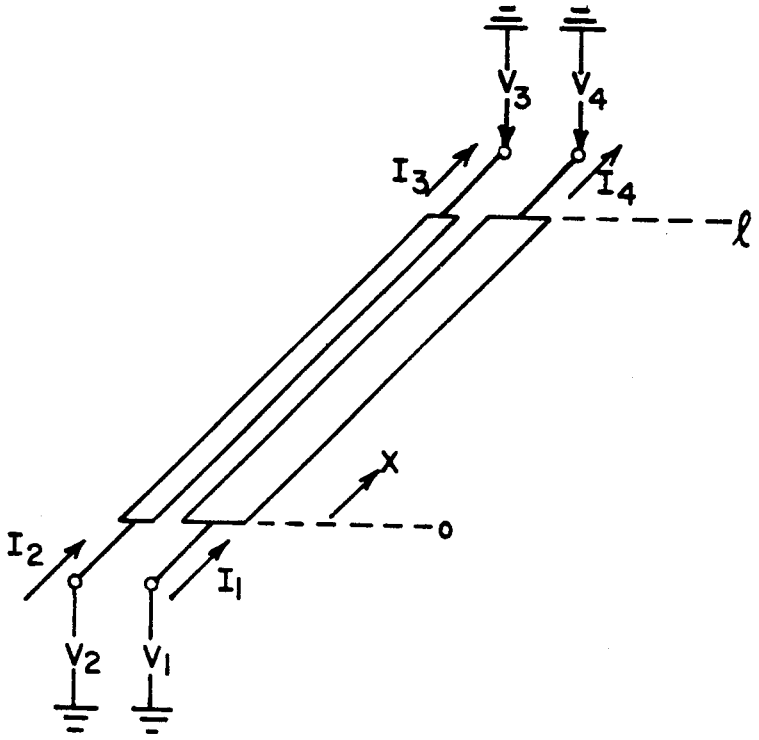
FIG. 3 illustrates relevant attributes of two parallel transmission lines.
Figure 4:
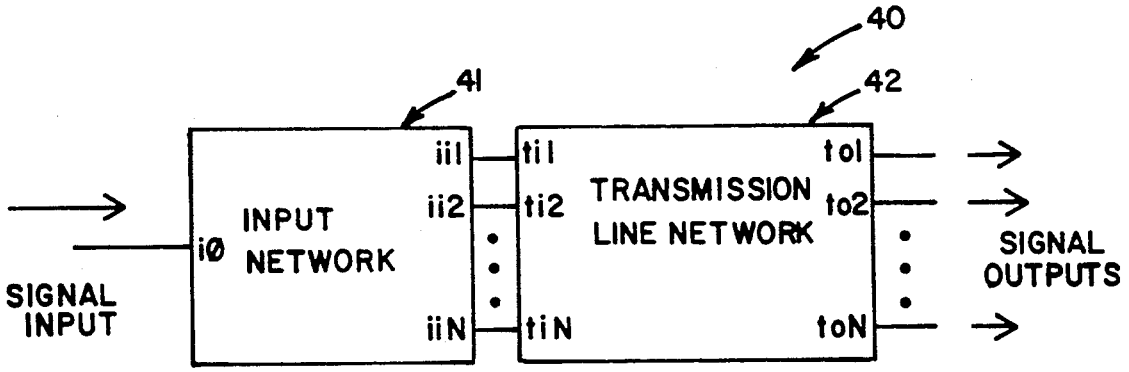
FIG. 4 is a general schematic of the present invention.
Figure 5:
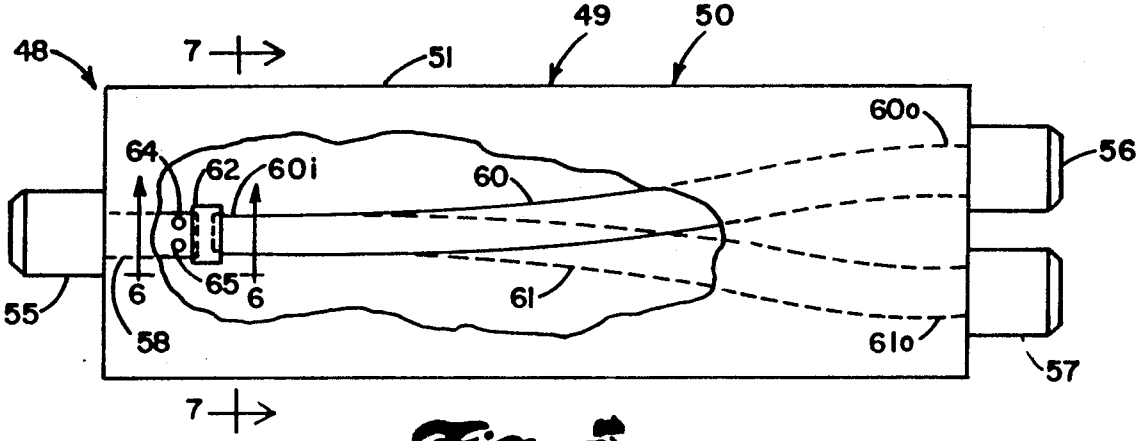
FIG. 5 is a partial fragmentary plan view of a first preferred embodiment of the invention.
Figure 7:
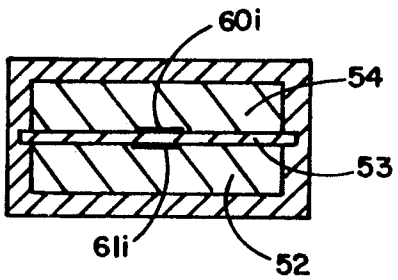
FIG. 7 is a cross section taken along line 7—7 in FIG. 5.
Figure 8:
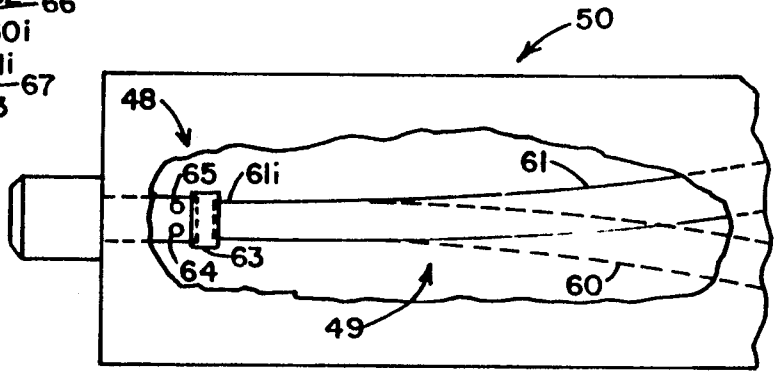
FIG. 8 is a view opposite from the plan view of FIG. 5.

The general solution for voltages and currents on the two lines shown in FIG. 3 is given by $$V_1 - A_1e^{-j\beta cx} = A_2e^{j\beta cx} + A_3e^{-j\beta xx} + A_4e^{j\beta xx} \quad (9)$$

$$V_2 - A_1R_ce^{-j\beta cx} + A_2R_ce^{j\beta cx} + A_3R_\pi e^{-j\beta xx} + A_4R_\pi e^{j\beta xx} \quad (10)$$

$$I_1 - A_1Y_{c1}e^{-j\beta cx} - A_2Y_{c1}e^{j\beta cx} + A_3Y_{\pi 1}e^{-j\beta xx} - A_4Y_{\pi 1}e^{j\beta xx} \quad (11)$$

$$I_2 - A_1R_cY_{c2}e^{-j\beta cx} - A_2R_cY_{c2}e^{j\beta cx} + A_3R_\pi Y_{\pi 2}e^{-j\beta xx} - A_4R_\pi Y_{\pi 2}e^{j\beta xx} \quad (12)$$

where $R_c$, $R_\pi$, $Y_{c1}$, $Y_{c2}$, $Y_{\pi 1}$, $Y_{\pi 2}$, $\beta_c$ and $\beta_\pi$ are the normal mode parameters for the coupled lines.

The normal mode parameters below are given by Tripathi in "Equivalent Circuits and Characteristics of Inhomogeneous Nonsymmetrical Coupled-line Two-port Circuits," *IEEE Transactions on Microwave Theory*

*and Techniques*, vol. MTT-25, pp. 140–142, February 1977.

$$\beta_{c,\pi} = \frac{\omega}{\sqrt{2}}\{L_{11}C_{11} + L_{22}C_{22} - 2L_{12}C_{12} \pm \sqrt{(L_{22}C_{22} - L_{11}C_{11})^2 + 4(L_{12}C_{11} - L_{22}C_{12})(L_{12}C_{22} - L_{11}C_{12})}\}^{\frac{1}{2}} \quad (13)$$

$$R_{c,\pi} = \frac{L_{22}C_{22} - L_{11}C_{11} \pm \sqrt{(L_{22}C_{22} - L_{11}C_{11})^2 + 4(L_{12}C_{11} - L_{22}C_{12})(L_{12}C_{22} - L_{11}C_{12})}}{2(L_{12}C_{22} - L_{11}C_{12})} \quad (14)$$

$$Z_{c1} = \frac{\beta_c}{\omega}\left(\frac{1}{C_{11} - R_cC_{12}}\right) = \frac{1}{Y_{c1}} \quad (15)$$

$$Z_{\pi 1} = \frac{\beta_\pi}{\omega}\left(\frac{1}{C_{11} - R_\pi C_{12}}\right) = \frac{1}{Y_{\pi 1}} \quad (16)$$

$$Z_{c2} = -R_cR_\pi Z_{c1} = \frac{1}{Y_{c2}} \quad (17)$$

$$Z_{\pi 2} = -R_cR_\pi Z_{\pi 1} = \frac{1}{Y_{\pi 2}} \quad (18)$$

$$\omega = 2\pi f \quad (19)$$

Following Tripathi, we will refer to $Z_{c1}$, $Z_{\pi 1}$, $Z_{c2}$ and $Z_{\pi 2}$, as the normal mode impedances of the coupled lines.

If ports 3 and 4 of the coupled lines are terminated with a matched termination network with a conductance matrix G, then $$\begin{bmatrix} I_1 \\ I_2 \end{bmatrix} = \begin{bmatrix} G_{11} & G_{12} \\ G_{12} & G_{22} \end{bmatrix}\begin{bmatrix} V_1 \\ V_2 \end{bmatrix} \quad (20)$$

Setting the terms with positive exponents to zero in (9), (10), (11) and (12) (corresponding to no reflections), we can obtain from (9), (10), (11), (12) and (20)

$$G_{11} = \frac{R_cY_{\pi 1} - R_\pi Y_{c1}}{R_c - R_\pi} \quad (21)$$

$$G_{12} = -\frac{Y_{\pi 1} - Y_{c1}}{R_c - R_\pi} \quad (22)$$

$$G_{22} = \frac{\frac{Y_{\pi 1}}{R_c} - \frac{Y_{c1}}{R_\pi}}{R_c - R_\pi} \quad (23)$$

The terminal voltages and currents of the coupled transmission lines shown in FIG. 3 are related by the ABCD matrix defined by $$\begin{bmatrix} V_1 \\ V_2 \\ I_1 \\ I_2 \end{bmatrix} = \begin{bmatrix} a_{11} & a_{12} & b_{11} & b_{12} \\ a_{21} & a_{22} & b_{21} & b_{22} \\ c_{11} & c_{12} & d_{11} & d_{12} \\ c_{21} & c_{22} & d_{21} & d_{22} \end{bmatrix}\begin{bmatrix} V_4 \\ V_3 \\ I_4 \\ I_3 \end{bmatrix} \quad (24)$$

The expressions below for the elements of the ABCD matrix are given by Speciale and Tripathi in the paper "Wave Modes and Parameter Matrices of Non-symmetrical Coupled Lines in a Non-homogeneous Medium," *Int. J. Electron.*, vol. 40, no. 4, pp. 371–375, 1976.

$$a_{11} = d_{11} = \frac{-R_\pi\cos\theta_c + R_c\cos\theta_\pi}{R_c - R_\pi}$$

$$a_{22} = d_{22} = \frac{R_c\cos\theta_c - R_\pi\cos\theta_\pi}{R_c - R_\pi} \quad (26)$$

$$a_{12} = \frac{a_{21}}{-R_cR_\pi} = d_{21} = \frac{d_{12}}{-R_cR_\pi} = \frac{(\cos\theta_c - \cos\theta_\pi)}{R_c - R_\pi} \quad (27)$$

$$b_{11} = \frac{j(-R_\pi Z_{c1}\sin\theta_c + R_cZ_{\pi 1}\sin\theta_\pi)}{(R_c - R_\pi)} \quad (28)$$

$$b_{22} = \frac{-jR_cR_\pi(R_cZ_{c1}\sin\theta_c - R_\pi Z_{\pi 1}\sin\theta_\pi)}{(R_c - R_\pi)} \quad (29)$$

$$b_{12} = b_{21} = \frac{-jR_cR_\pi(Z_{c1}\sin\theta_c - Z_{\pi 1}\sin\theta_\pi)}{(R_c - R_\pi)} \quad (30)$$

$$c_{11} = \frac{-j(R_\pi Y_{c1}\sin\theta_c - R_cY_{\pi 1}\sin\theta_\pi)}{(R_c - R_\pi)} \quad (31)$$

$$c_{22} = \frac{-j\left[\frac{Y_{c1}}{R_\pi}\sin\theta_c - \frac{Y_{\pi 1}}{R_c}\sin\theta_\pi\right]}{(R_c - R_\pi)} \quad (32)$$

$$c_{12} = c_{21} = \frac{j(Y_{c1}\sin\theta_c - Y_{\pi 1}\sin\theta_\pi)}{(R_c - R_\pi)} \quad (33)$$

$$\theta_c = \beta_c l \quad (34)$$

$$\theta_\pi = \beta_\pi l \quad (35)$$

where I is the length of the transmission lines.

Two Asymmetric Lossless Transmission Lines in a Homogeneous Medium

For this case, from (8) the elements of the matched termination conductance matrix [G] are given by $$G_{11} - \nu C_{11} \quad (36)$$

$$G_{12} - \nu C_{12} \quad (37)$$

$$G_{22} - \nu C_{22} \quad (38)$$

where v is the velocity of propagation in the medium. Also, equations (13)–(18), and (25)–(35) can be reduced to the simpler expressions $$\beta_c = \beta_\pi = \beta = \frac{\omega}{V} \tag{39}$$

$$R_c = -R_\pi = R = \sqrt{\frac{C_{11}}{C_{22}}} \tag{40}$$

$$Z_{c1} = \frac{1}{V}\left[\frac{1}{C_{11} - RC_{12}}\right] = \frac{1}{Y_{c1}} \tag{41}$$

$$Z_{\pi 1} = \frac{1}{V}\left(\frac{1}{C_{11} + RC_{12}}\right) = \frac{1}{Y_{\pi 1}} \tag{42}$$

$$Z_{c2} = R^2 Z_{c1} = \frac{1}{Y_{c2}} \tag{43}$$

$$Z_{\pi 2} = R^2 Z_{\pi 1} = \frac{1}{Y_{\pi 2}} \tag{44}$$

$$a_{11} = a_{22} = d_{11} = d_{22} = \cos\theta \tag{45}$$

$$a_{12} = a_{21} = d_{12} = d_{21} = 0 \tag{46}$$

$$b_{11} = \frac{j(Z_{c1} + Z_{\pi 1})\sin\theta}{2} \tag{47}$$

$$b_{22} = \frac{jR^2(Z_{c1} + Z_{\pi 1})\sin\theta}{2} \tag{48}$$

$$b_{12} = b_{21} = \frac{jR(Z_{c1} - Z_{\pi 1})\sin\theta}{2} \tag{49}$$

$$C_{11} = \frac{j(Y_{c1} + Y_{\pi 1})\sin\theta}{2} \tag{50}$$

$$C_{22} = \frac{j(Y_{c1} + Y_{\pi 1})\sin\theta}{2R^2} \tag{51}$$

$$C_{12} = C_{21} = \frac{j(Y_{c1} - Y_{\pi 1})\sin\theta}{2R} \tag{52}$$

$$\theta_c = \theta_\pi = \theta = \beta l \tag{53}$$

The Invention Generally

Power divider 40 comprises an input network 41 and a transmission line network 42. Input network 41 includes an input port i0, n interconnection ports (ii1, ii2, . . . iin), and signal paths between the input port and the interconnection ports.

Transmission line network 42 includes n interconnection ports (ti1, ti2, . . . , tin), n output ports (to1, to2, . . . , ton) and N generally parallel transmission lines connecting the interconnection ports to the output ports. The transmission lines are significantly coupled together at the interconnection ports. The transmission line network is designed to match the divider output port impedances to the output impedances of respective ports of the input network in a manner to provide that all output ports of the divider are matched and isolated from each other.

Port impedances are typically 50 ohms but could also have other values.

Also used herein, N generally parallel transmission lines are significantly coupled together at a location x if the capacitive coupling coefficient $K_c$, as defined above in equation (4), between any two of the transmission lines is greater than 0.1. Also, an impedance transformation is considered a low reflection transformation if typically less than about 4 percent of the power in a signal input into an output port is reflected back because of reflections from the transformation. Similarly, the output of the input network provides a low reflection termination to signals incident from the input ends of the transmission lines if typically less than about 4 percent of the power incident from the input end of any of the transmission lines is reflected back toward the output.

Two-Way Equal-Division Power Divider

Figure 9:
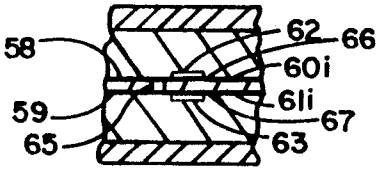
FIG. 9 is a schematic of the embodiment of FIGS. 5—8.
Figure 9:
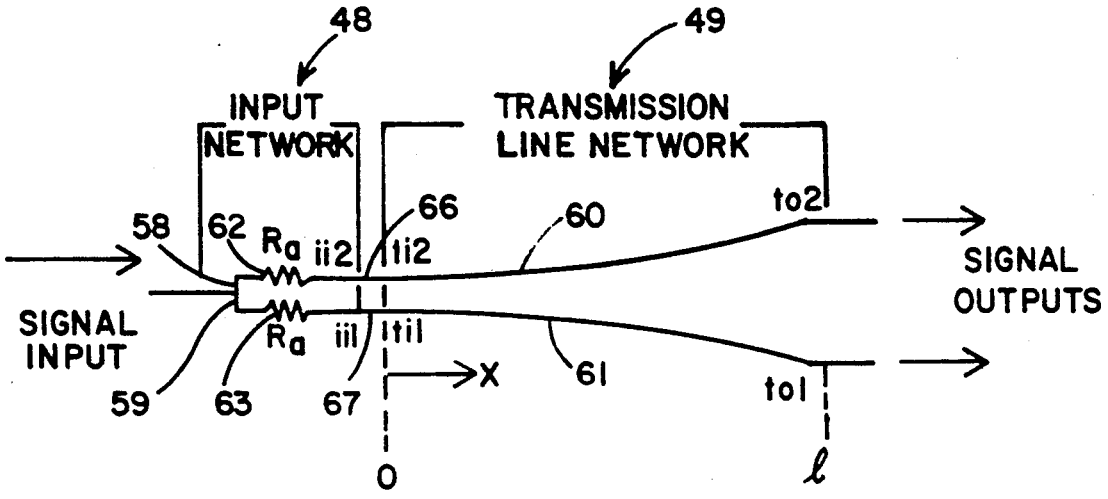

A first preferred embodiment of the present invention is shown in FIGS. 5–8. This embodiment is a 2-way equal division power divider 50. A schematic of this embodiment is shown in FIG. 9. Power divider 50 comprises an outer conductor 51 which has a generally rectangular cross section and is filled with a lower dielectric sheet 52, a center dielectric sheet 53 and an upper dielectric sheet 54. The dielectric sheets are made of low loss material such as teflon or "duroid 5880" manufactured by Rogers Corp., Chandler, Ariz.

Power divider 50 includes an input network 48 and a transmission line network 49. Network 48 includes input connector 55, conductors 58 and 59, resistors 62 and 63 and conductive elements 64 and 65. Transmission line network 49 includes conductors 60 and 61, and associated output connectors 56 and 57. Conductors 58, 59, 60 and 61 are photo-etched from a conducting material (here copper) that has been deposited or laminated to both surfaces of the center dielectric sheet. Conductors 60 and 61 are spaced a maximum distance from each other at their outputs **60*o* and 61*o* and are in close proximity to each other at their inputs 60*i* and 61*i*. The input conductor consists of conductors 58 and 59 that are connected together with conductive elements 64 and 65 which are plated through holes. Resistors 62 and 63 are connected respectively between conductors 60*i* and 61*i* and input conductors 58 and 59. The connections 66 and 67 between resistors 62 and 63, and transmission lines 60 and 61, respectively, are also referred to as interconnection ports. The resistors consist of resistive thin film deposited on a ceramic substrate, and are referred to in the art as "chip" resistors. For optimum high frequency operation it is important that conductive elements 64 and 65 be located close to where resistors 62 and 63 connect to conductors 58 and 59. The input signal is applied to input connector 55 and the equally divided signals leave the power divider from output connectors 56 and 57**.

A transmission line section that provides a high pass match between two transmission lines of different characteristic impedances has been described by R. E. Collin in "The Optimum Tapered Line Matching Section," *Proceedings of the IRE*, vol. 44, April 1956, pp. 539–548. This design uses a continuously varying impedance and depends upon parameters R,l,$\epsilon_r$,$\rho_m$ and $\bar{n}$ where R is the ratio of the two impedances, l is the length of the section, $\epsilon_r$ is the relative dielectric constant in the section, $\rho_m$ is the magnitude of the maximum reflection coefficient, and $\bar{n}$ is a positive integer that relates to how fast the reflection coefficient decays with increasing frequency.

This impedance transforming transmission line section is used in the first and third preferred embodiments of the present invention and will be referred to as a Collin impedance transformer.

is used for both the even-mode and odd-mode impedance transformers.

$$P_{in} = \frac{R_a - 100\rho_c\left\{\left(\frac{R_a + 100}{50}\right), n, \mu_o, \mu,\right\}}{R_a + 100} \tag{56}$$

$$\rho_{out} = \frac{1}{2}\left[\rho_c\left\{\left(\frac{R_a + 100}{50}\right), n, \mu_o, \mu\right\} - \rho_c\left\{\left(\frac{50}{R_a}\right), n, \mu_o, \mu\right\}\right] \tag{57}$$

$$\text{Isolation} = 20\log\left[\frac{2}{\left|\rho_c\left\{\left(\frac{R_a + 100}{50}\right), n, \mu_o, \mu\right\} + \rho_c\left\{\left(\frac{50}{R_a}\right), n, \mu_o, \mu\right\}\right|}\right] \tag{58}$$

where $$\rho_c\{R, n, \mu_o, \mu\} = \frac{\theta^{-j\pi\mu}\ln(R)\sin(\pi\mu)}{2\pi\mu}\left[\frac{\prod_{n=1}^{n-1}\left\{1 - \left(\frac{\mu}{n}\right)^2\left[\frac{\mu_o^2 + \left(n - \frac{1}{2}\right)^2}{\mu_o^2 + \left(n - \frac{1}{2}\right)^2}\right]\right\}}{\prod_{n=1}^{n-1}\left\{1 - \left(\frac{\mu}{n}\right)^2\right\}}\right] \tag{59}$$

$$\mu_o = \frac{1}{\pi}\cosh^{-1}\left(\frac{\ln(R)}{2\rho_m}\right) \tag{60}$$

$$\mu = \frac{\text{rad}\, l\, \epsilon_r f}{1.5 \times 10^{11}} \tag{61}$$

Figure 10A:
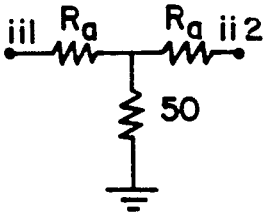
FIG. 10*a*, 10*b* and 10*c* are networks representative of the embodiment of FIGS. 5-8.
Figure 10B:
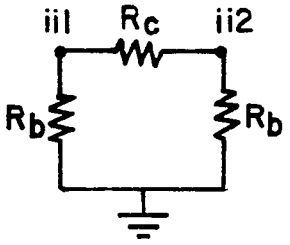
Figure 10C:
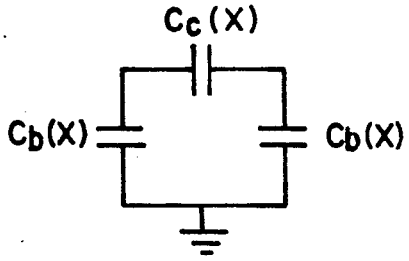
Figure 11A:
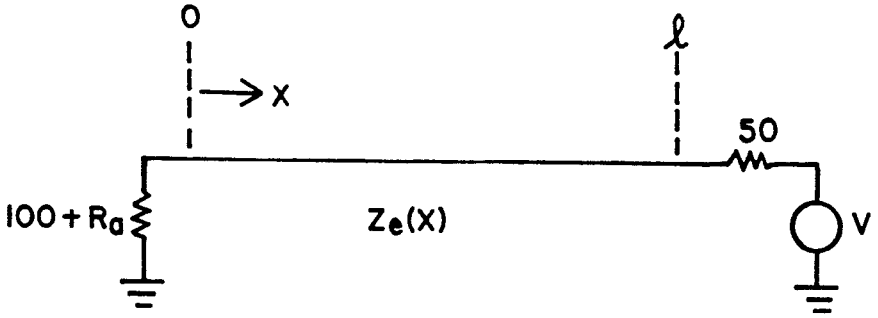
FIGS. 11*a* and 11*b* are illustrations of the even and odd mode circuits of the embodiment of FIGS. 5-8.
Figure 11B:
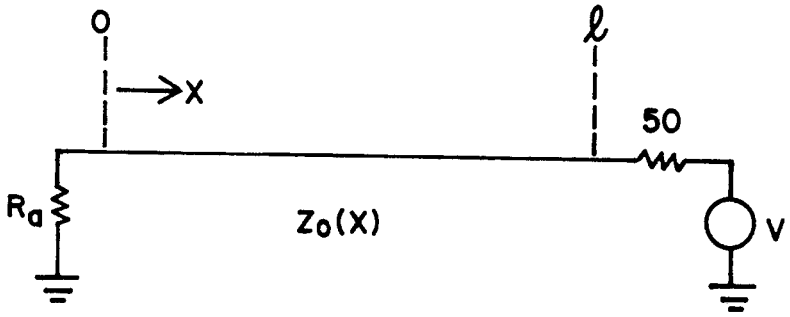

The network of FIG. 10*a* is seen looking toward the input at terminals ii1 and ii2. The network of FIG. 10*b* is equivalent to that of FIG. 10*a*. In the network of FIG. 10*b*, $R_b = 100 + R_a$ and $R_c = R_a(100 + R_a)/50$. At any location x along the coupled transmission lines the capacitances of the lines are as shown in FIG. 10*c*. The output VSWR and isolation of this preferred embodiment can be analyzed using the even-mode and odd-mode approach used by Cohn in the above referenced paper. The even-mode and odd-mode circuits are shown in FIGS. 11*a* and 11*b*. The even-mode impedance $Z_e(x)$ and odd-mode impedance $Z_o(x)$ at a location x are given by $$Z_e(x) = \frac{1}{\nu C_b(x)} \tag{54}$$

$$Z_o(x) = \frac{1}{\nu(C_b(x) + 2C_c(x))} \tag{55}$$

The even-mode characteristic impedance is varied from 50 ohms at x=1 to $100 + R_a$ ohms at x=0 according to a Collin impedance transformer. The odd-mode characteristic impedance is varied from 50 ohms at x=1 to $R_a$ ohms at x=0 according to a Collin impedance transformer. This is equivalent to having the transmission line network match the 50 ohm uncoupled output port impedances to the matched termination network of FIG. 10*b*. The even-mode odd-mode analysis gives (using equations from Collin's paper) the following equations for input reflection coefficient ($\rho_{in}$), output reflection coefficient ($\rho_{out}$) and isolation between output ports. In these equations it is assumed that the same $\rho_m$ I is in millimeters, and f is frequency.

In the pass band of the transmission line network it can be shown that the power divider insertion loss, due to power loss in the resistors, is closely approximated by $$\text{Insertion Loss} = 10\log\left(1 + \frac{R_a}{100}\right) \tag{62}$$

It can also be shown that, as frequency increases, the pass band input VSWR approaches $$\text{Input } VSWR = 1 + \frac{R_a}{50} \tag{63}$$

Due to symmetry, the two output signals will be theoretically equal in amplitude and phase.

Equations 56–61 were used to calculate input VSWR, output VSWR and isolation for a power divider with the following parameters l=188 millimeters, $\epsilon_r = 2.1$, $R_a = 10$ ohms, $\rho_m = 0.075$, and n=10.

Figure 12:
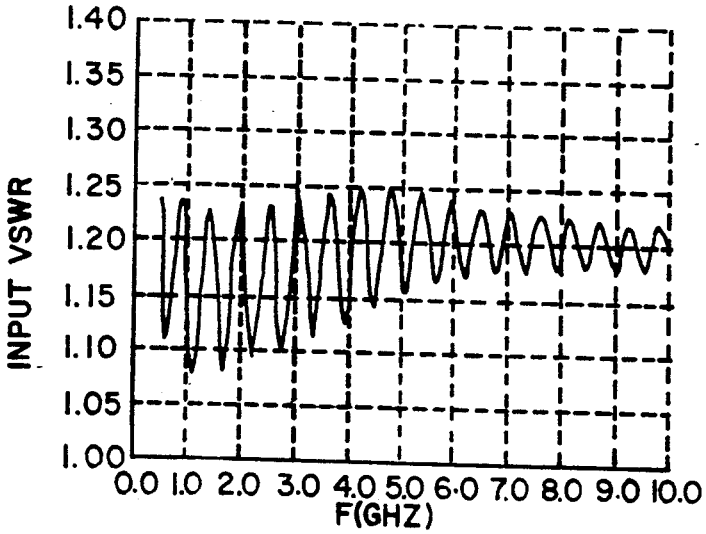
FIG. 12 is a plot of the calculated input VSWR as a function of frequency of the circuit of FIG. 9 with selected parameter values.
Figure 13:
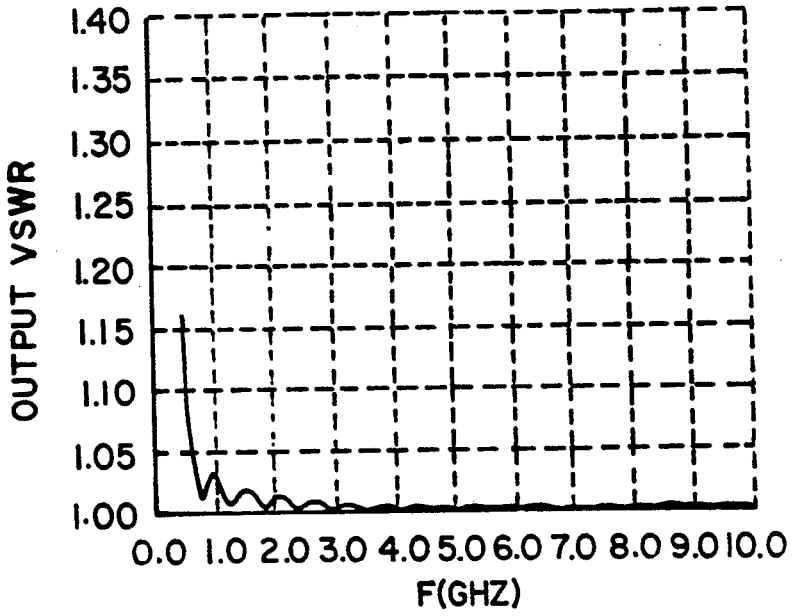
FIG. 13 is a plot of the calculated output VSWR as a function of frequency of the circuit of FIG. 9 with selected parameter values.
Figure 14:
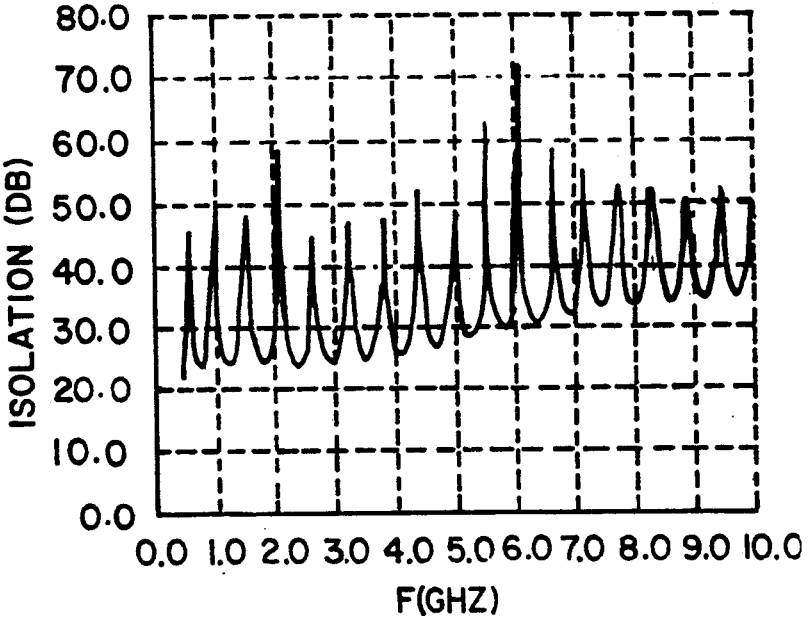
FIG. 14 is a plot of the calculated isolation as a function of frequency of the circuit of FIG. 9 with selected parameter values.
Figure 15:
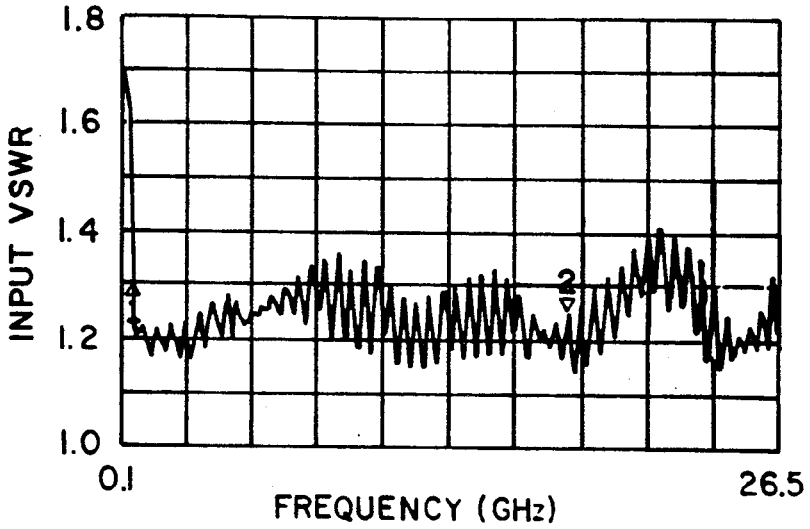
FIG. 15 is a plot of the measured input VSWR as a function of frequency of the embodiment of FIGS. 5-8.
Figure 16:
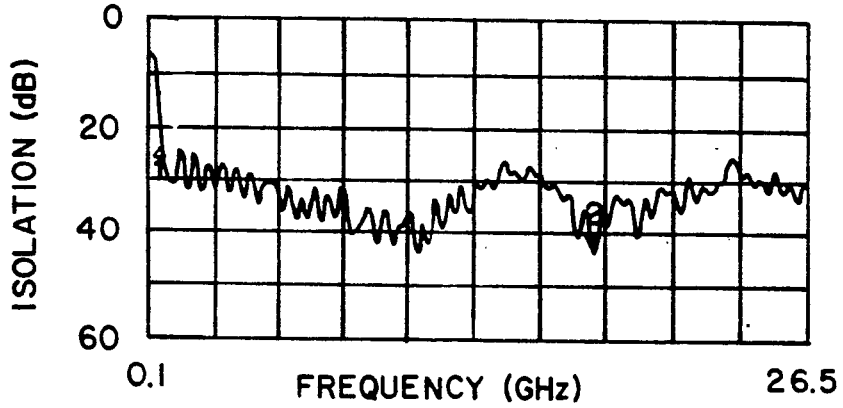
FIG. 16 is a plot of the measured isolation as a function of frequency of the embodiment of FIGS. 5-8.
Figure 17:
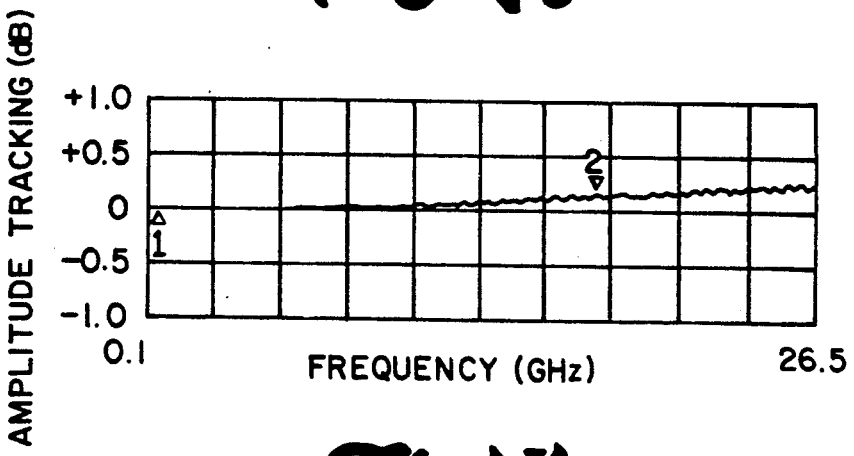
FIG. 17 is a plot of the measured amplitude tracking as a function of frequency of the embodiment of FIGS. 5-8.
Figure 18:
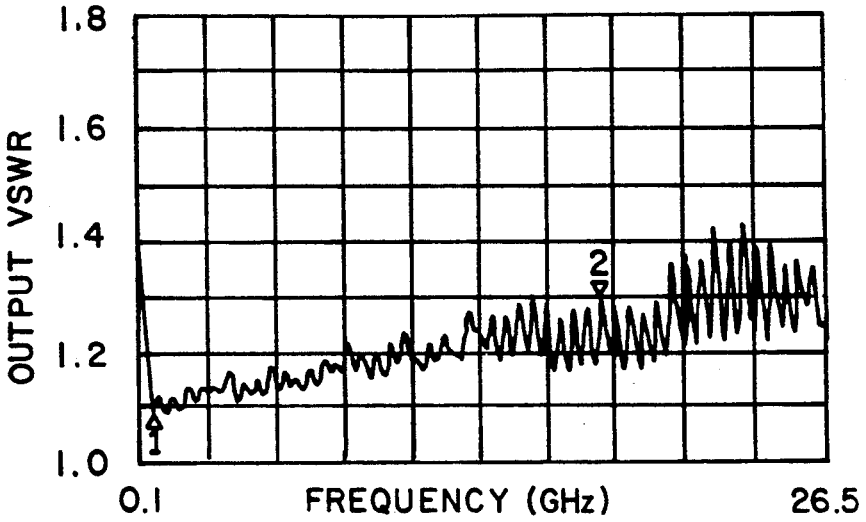
FIG. 18 is a plot of the measured output VSWR as a function of frequency of the embodiment of FIGS. 5-8.
Figure 19:
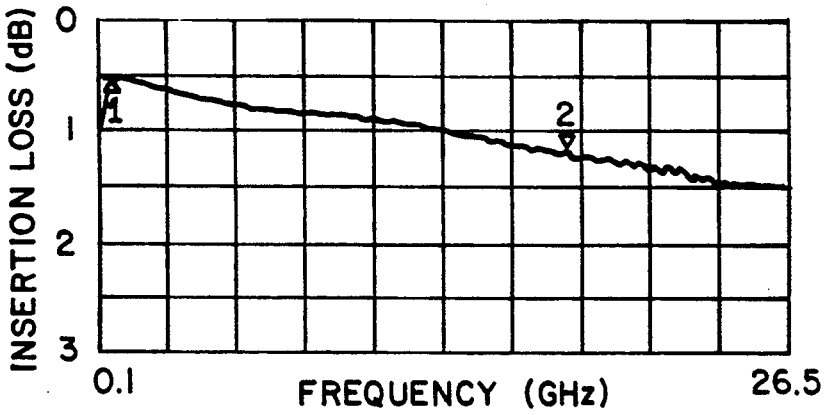
FIG. 19 is a plot of the measured insertion loss as a function of frequency of the embodiment of FIGS. 5-8.
Figure 20:
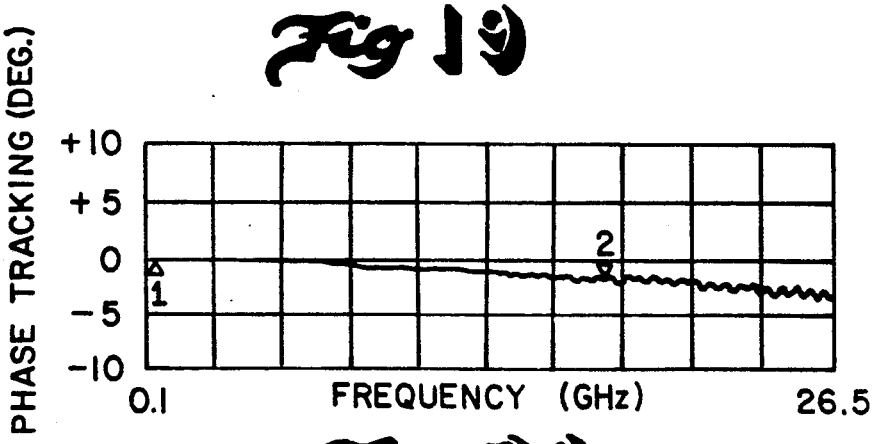
FIG. 20 is a plot of the measured phase tracking as a function of frequency of the embodiment of FIGS. 5-8.
Figures 21, 22, 23, 24:
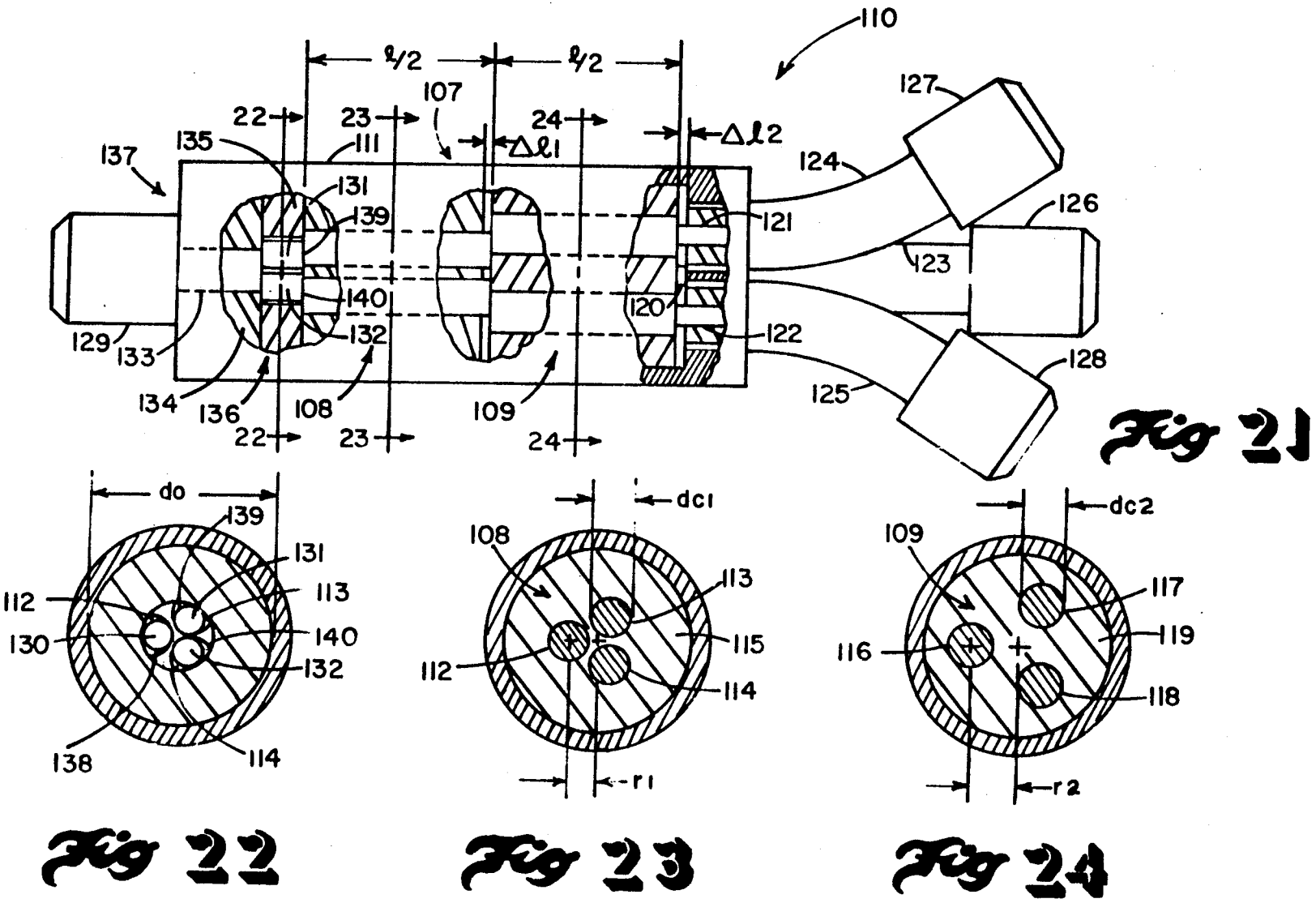
FIG. 21 is a plan view of a second preferred embodiment of the invention.
FIG. 22 is a cross section taken along line 22—22 of FIG. 21.
FIG. 23 is a cross section taken along line 23—23 of FIG. 21.
FIG. 24 is a cross section taken along line 24—24 of FIG. 21.

The results are plotted in FIGS. 12–14 for frequencies from 0.5–10.0 GHz. These curves show that the design has a high pass response. Substituting $R_a = 10$ in (62) and (63) gives a pass band insertion loss of 0.41 dB and input VSWR that approaches 1.2. From FIG. 12 it can be seen that, as frequency increases, input VSWR approaches 1.2 as predicted by (63). This is a consequence of choosing to have the even-mode Collin impedance transformer match from 50 ohms to $100+R_a$ ohms. This was done to maximize output isolation, which is shown in FIG. 14. If the even-mode Collin impedance transformer had matched 50 ohms to 100 ohms the input VSWR would have approached 1.1 but output VSWR, shown in FIG. 13, would have increased (approaching 1.1) and isolation would have decreased. In all preferred embodiments discussed we have chosen to have the transmission line network match for maximum isolation. It is recognized that the transmission line networks could be somewhat modified to improve input VSWR with some degradation in output VSWR and isolation—but this would not change the principle of operation of present invention.

This preferred embodiment was fabricated using 1.016 mm thick teflon outer dielectric boards and a centerboard of 0.127 mm thick Rogers 5880 duroid with ½ ounce copper. The strip line width dimensions were calculated using an approach similar to that used by Shelton in the paper "Impedances of Offset Parallel-Coupled Strip Transmission Line," *IEEE Transactions on Microwave Theory and Techniques*, vol. MTT-14, January 1966, pp. 7–15. At the input of the transmission line network conductor 60*i* is directly over conductor 61*i*, and their line widths are 1.321 mm—giving a coupling coefficient from equation (4) of 0.833. At the output of the transmission line network the line widths are 1.829 mm to give a 50 ohm characteristic impedance. Input conductors 58 and 59 have line widths of 1.575 mm to give a 50 ohm characteristic impedance. Measured plots of input VSWR, isolation, amplitude tracking, output VSWR, insertion loss and phase tracking are shown in FIGS. 15–20, respectively, for frequencies from 0.1 to 26.5 GHz, with frequency markers at 0.5 and 18 GHz. Amplitude and phase tracking are the ratio of one output to the other in dB and degrees respectively. The increasing insertion loss (above the theoretical 0.41 dB) with increasing frequency is due to dielectric and copper losses not considered in the analysis.

As is well known by those skilled in the art, the electrical characteristics of the input network resistors will depart from those of "ideal" resistors as frequency increases at the upper end of the device operating frequency range. This is due to the inevitable parasitic reactances of the resistors. In order to minimize performance degradation due to this effect it is desirable to make the dimensions of each resistor less than ¼ free space wavelength at the highest operating frequency of the device.

It is apparently generally believed that coupling between two TEM or Quasi-TEM mode parallel transmission lines is inherently contra-directional. That is—a signal propagating on one of the lines will induce a signal propagating in the opposite direction on the other line. This theory was stated by Oliver in the paper "Directional Electromagnetic Couplers," *Proc. IRE*, vol. 42, November 1954, pp. 1686–1692. This theory has been restated by numerous authors including Levy and Cohn in the paper "History of Passive Components with Particular Attention to Directional Couplers," *IEEE Transactions on Microwave Theory and Techniques*, vol. MTT-32, September 1984, pp. 1046–1054.

It is clear from the analysis that this embodiment is inconsistent with this theory. The two transmission lines are generally parallel—yet a signal into one output port does not induce a signal in the other transmission line to cause an output at the other output port. The existence of a matched termination network as described by Amemiya is also inconsistent with the theory, since a signal in one line will not cause a contra-directional signal in a parallel coupled line if both lines are terminated in their matched termination network. The various types of well known TEM mode contra-directional directional couplers described by Oliver, Levy et al. and many others are not contra-directional because of inherent contra-directional coupling between the parallel transmission lines—but because the coupled out signal is the result of signal reflections in the two-line system.

Three-Way Equal Division Power Divider

Figure 25:
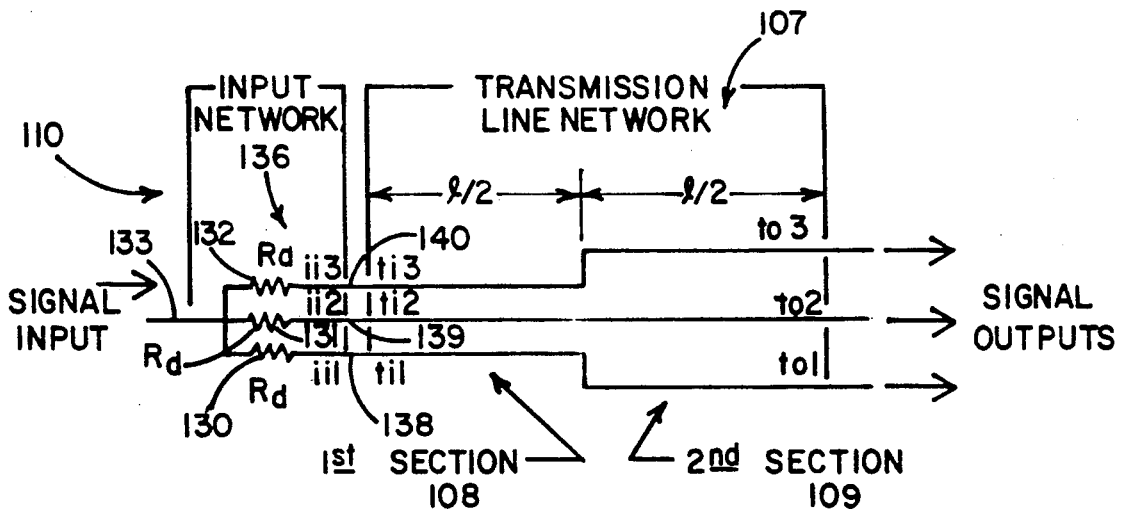
FIG. 25 is a schematic of the embodiment of FIGS. 21-24.

A second preferred embodiment of the present invention is shown in FIGS. 21–24. This embodiment is a 3-way equal division power divider 110 that covers a bandwidth of approximately 60 percent. A schematic of this embodiment is shown in FIG. 25. In this embodiment, power divider 110 has a transmission line network 107 consisting of first and second transmission line sections 108 and 109, respectively, each of length l/2, disposed within outer conductor 111 of circular cross section and inside diameter do. The first transmission line section 108 consists of three parallel cylindrical conductors 112, 113 and 114 located within dielectric 115. Conductors 112, 113 and 114 each have diameters dc1, have centers at distance r1 from the centerline and are positioned 120° apart. The second transmission line section 109 consists of three parallel cylindrical conductors 116, 117 and 118 located within dielectric 119. Conductors 116, 117 and 118 each have diameters dc2, have centers a distance r2 from the centerline, and are also positioned 120° apart.

At the intersection of the two transmission line sections conductors 112, 113 and 114 are soldered or welded respectively to conductors 116, 117 and 118. At this intersection there is also a short section of air dielectric of length Δl1. This section compensates for the discontinuities at the junction of conductors of the first and second sections—a technique well known to those skilled in the art. At the output end of the second section conductors 116, 117 and 118 are soldered or welded respectively to center conductors 120, 121 and 122 of semi-rigid cables 123, 124 and 125. An air line section of length Δl2 is provided to compensate for the discontinuities caused by these connections.

The outer conductors of the semi-rigid cables are soldered or welded to outer conductor 111. The semi-rigid cables are necessary because conductors 116, 117 and 118 are in too close proximity to facilitate direct connection to output connectors 126, 127 and 128. Semi-rigid cables 123, 124 and 125 are connected respectively to output connectors 126, 127 and 128, all of which are also included in this embodiment of the transmission line network.

Power divider 110 has an input network 136 consisting of an input transmission line section 137 connected at its input end to input connector 129 and at the opposite end to section 108 conductors 112, 113 and 114 through respectively resistors 130, 131 and 132. The input transmission line section 137 has a cylindrical center conductor 133 of diameter di positioned within dielectric 134. Resistors 130, 131 and 132 are each made of a resistive film deposited on a ceramic rod with conductor contacts at each end. These resistors are connected to the conductors with solder or conductive epoxy. Resistors 130, 131 and 132 are surrounded by dielectric 135. Dielectrics 115, 119, 134 and 135 are made of a low loss material such as teflon. The connection between respective resistors 130, 131 and 132, and transmission line conductors 112, 113 and 114 form interconnection ports 138, 139 and 140, respectively.

Figure 2:
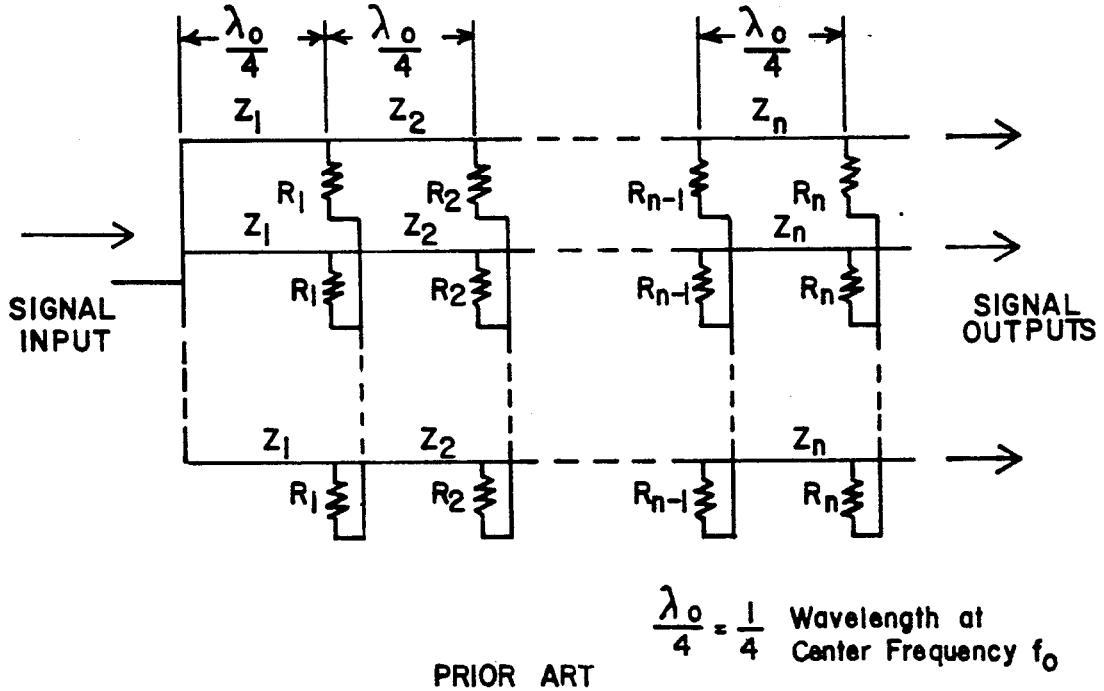
PRIOR ART Fig 2
FIG. 2 is a schematic diagram of a conventional power divider described by Yee et al.
Figure 26A:
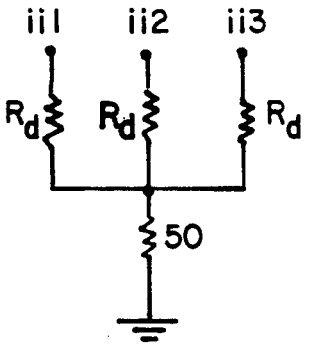
FIGS. 26*a*-26*d* are networks representative of the embodiment of FIGS. 21-24.
Figure 26B:
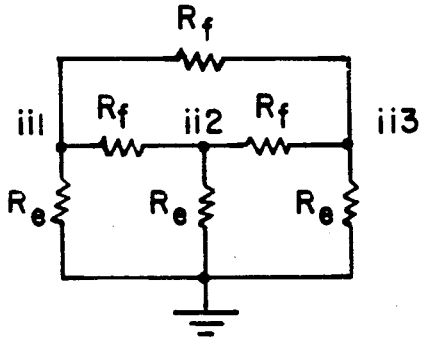
Figure 26C:
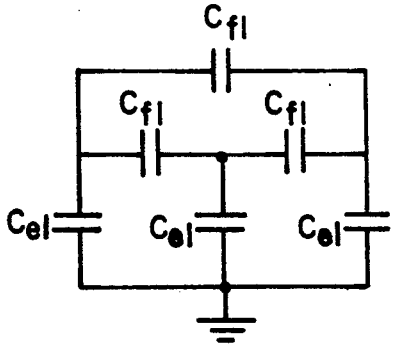
Figure 26D:
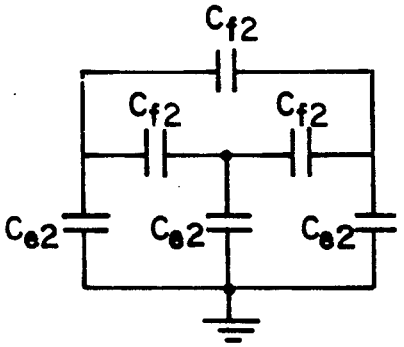

The network of FIG. 26*a* is seen looking toward the input at terminals ii1, ii2 and ii3. The network of FIG. 26*b* is equivalent to that of FIG. 26*a*, where $R_e=150+R_d$ and $R_f=R_d(150+R_d)/50$. Two section stepped impedance transformers with sections of length l/2 are used to match the 50 ohm uncoupled output impedances to the matched termination network of FIG. 26*b*. Tables of impedance values for these type of impedance transformers are given by Young in the paper "Tables of Cascaded Homogeneous Quarter-Wave Transformers," *IRE Transactions on Microwave Theory and Techniques*, vol. MTT-7, April 1958, pp. 233–237. The capacitances of the coupled lines of the first section are shown in FIG. 26*c*. Capacitances of the coupled lines of the 2nd section are shown in FIG. 26*d*. Due to symmetry, the output VSWR and isolation can be analyzed using an even-mode odd-mode analysis. The VSWR at port to2 and isolation between to2 and either to1 or to3 can be obtained by superimposing the solutions to 1. Applying $+\frac{1}{3}$ volt through 50 ohms impedances to all three output ports—giving the equivalent circuit of FIG. 27, and 2. Applying $+\frac{2}{3}$ volt through 50 ohms to to2 and $-\frac{1}{3}$ volt through 50 ohm impedances to to1 and to3—giving the equivalent circuit of FIG. 28. The even mode impedances $Z_{e1}$ and $Z_{e2}$ are given by $$Z_{e1} = \frac{1}{\nu C_{e1}} \tag{64}$$

$$Z_{e2} = \frac{1}{\nu C_{e2}} \tag{65}$$

The odd mode impedances $Z_{o1}$ and $Z_{o2}$ are given by $$Z_{o1} = \frac{1}{\nu(C_{e1} + 3C_{f1})} \tag{66}$$

$$Z_{o2} = \frac{1}{\nu(C_{e2} + 3C_{f2})} \tag{67}$$

Figure 27:
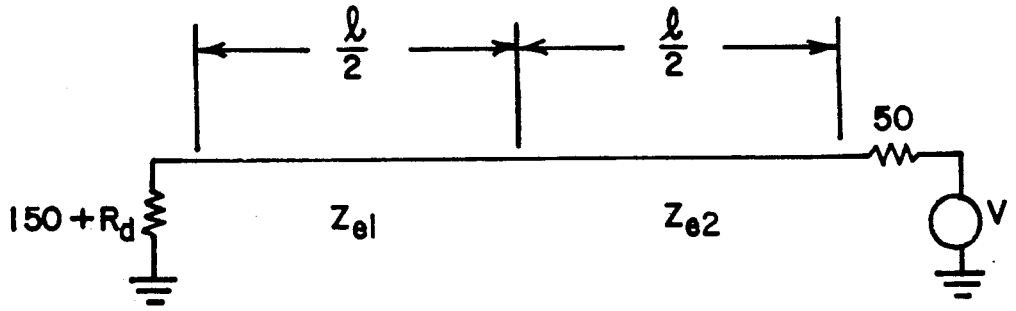
FIGS. 27 and 28 are illustrations of the even and odd mode circuits of the embodiment of FIGS. 21-24.
Figure 28:
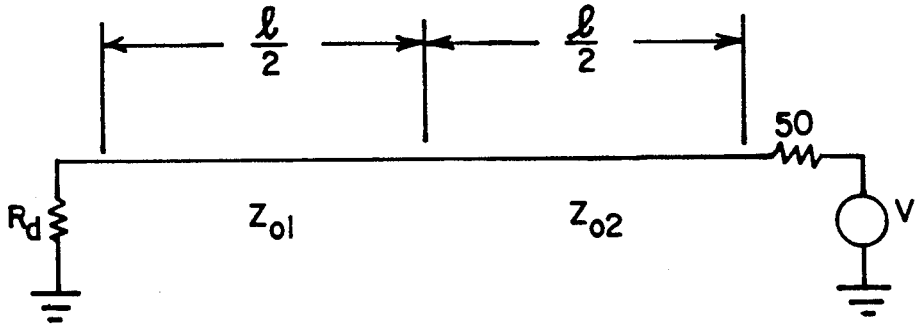

The even mode impedance transformer of FIG. 27 matches the 50 ohm output impedance to $R_e=150+R_d$. The odd mode impedance transformer of FIG. 28 matches the 50 ohm output impedance to $R_d$. This is equivalent to having the transmission line network match the 50 ohm uncoupled output port impedances to the matched termination network of FIG. 26*b*. The even-mode odd-mode analysis gives the following equations for the input reflection coefficient ($\rho_{in}$), output reflection coefficient ($\rho_{out}$) and isolation between output ports. where $$\rho_{in} = \frac{R_d - 150 + ZI\{Z_{e1},ZI\{Z_{e2},50,\theta\},\theta\}}{R_d + 150 + ZI\{Z_{e1},ZI\{Z_{e2},50,\theta\},\theta\}} \tag{68}$$

$$\rho_{out} = \frac{\rho_{e3}}{3} + \frac{2\rho_{o3}}{3} \tag{69}$$

-continued $$\text{Isolation} = 20\log\left\{\frac{3}{|\rho_{e3} - \rho_{o3}|}\right\} \tag{70}$$

$$\rho_{e3} = \frac{ZI\{Z_{e2},ZI\{Z_{e1},(R_d + 150),\theta\},\theta\} - 50}{ZI\{Z_{e2},ZI\{Z_{e1},(R_d + 150),\theta\},\theta\} + 50} \tag{71}$$

$$\rho_{o3} = \frac{ZI\{Z_{o2},ZI\{Z_{o1},R_d,\theta\},\theta\} - 50}{ZI\{Z_{o2},ZI\{Z_{o1},R_d,\theta\},\theta\} + 50} \tag{72}$$

$$ZI\{Z_{os},Z,\theta\} = Z_{os}\left[\frac{Z + jZ_{os}\text{Tan}(\theta)}{Z_{os} + jZ\text{Tan}(\theta)}\right] \tag{73}$$

$$\theta = \frac{\pi\sqrt{\epsilon_r}\, f}{3.0 \times 10^{11}} \tag{74}$$

l is in millimeters, and f is frequency.

In the pass band of the transmission line network it can be shown that the 3-way power divider insertion loss, due to power loss in the resistors, is closely approximated by $$\text{Insertion Loss} - 10\log\left\{1 + \frac{R_d}{150}\right\} \tag{75}$$

Due to symmetry, the three output signals will be theoretically equal in amplitude and phase.

A design example of this 2nd embodiment was analyzed with the following parameters l=10.0 millimeters
$\epsilon_r=2.1$
$R_d=15.15$ ohms
do=5.0 millimeters
$Z_{e1}=118.39$ ohms
$Z_{o1}=21.13$ ohms
$Z_{e2}=69.75$ ohms
$Z_{o2}=35.84$ ohms From (4), (64) and (66) it can be shown that the capacitive coupling coefficient $K_c$ between any two conductors of the first section is given by;

$$K_c = \frac{C_{f1}}{C_{e1} + C_{f1}} = \frac{Z_{e1} - Z_{o1}}{Z_{e1} + 2Z_{o1}} \tag{76}$$

Figure 29:
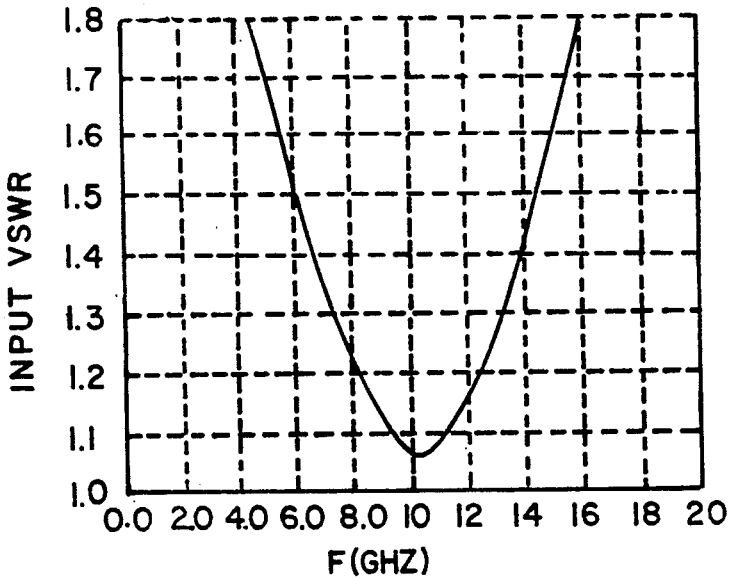
FIG. 29 is a plot of the calculated input VSWR as a function of frequency of the circuit of FIG. 25 with selected parameter values.
Figure 30:
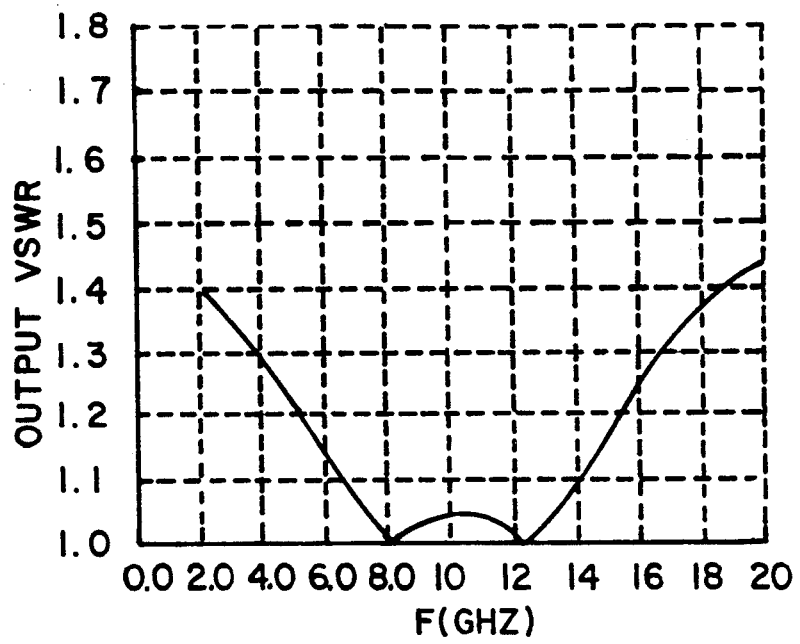
FIG. 30 is a plot of the calculated output VSWR as a function of frequency of the circuit of FIG. 25 with selected parameter values.
Figure 31:
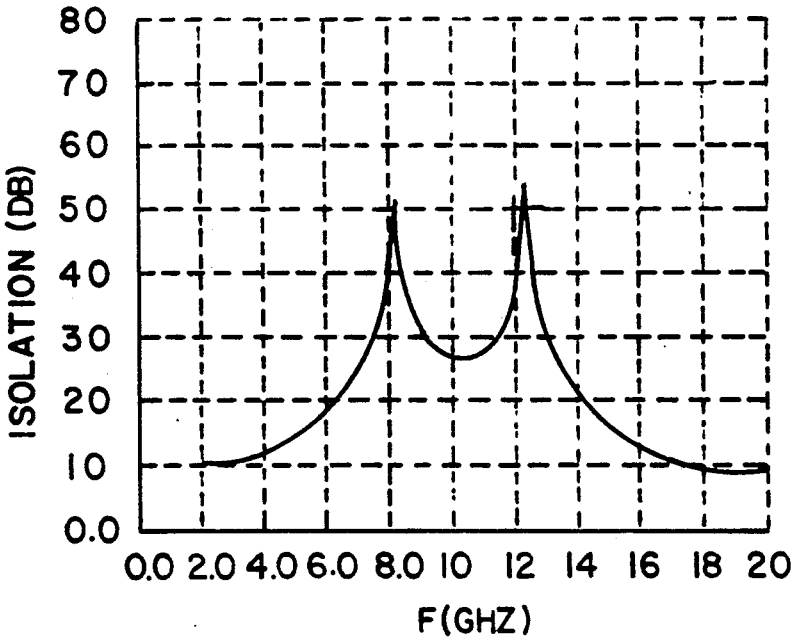
FIG. 31 is a plot of the calculated isolation as a function of frequency of the circuit of FIG. 25 with selected parameter values.
Figure 32:
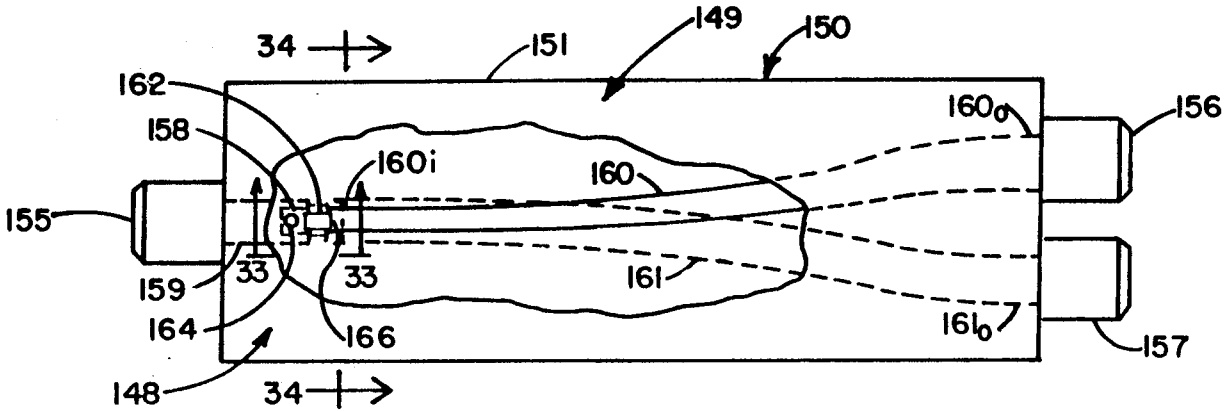
FIG. 32 is a plan view of a third preferred embodiment of the invention.
Figure 34:
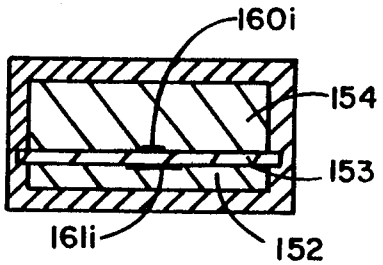
FIG. 34 is a cross section taken along line 34—34 of FIG. 32.
Figure 35:
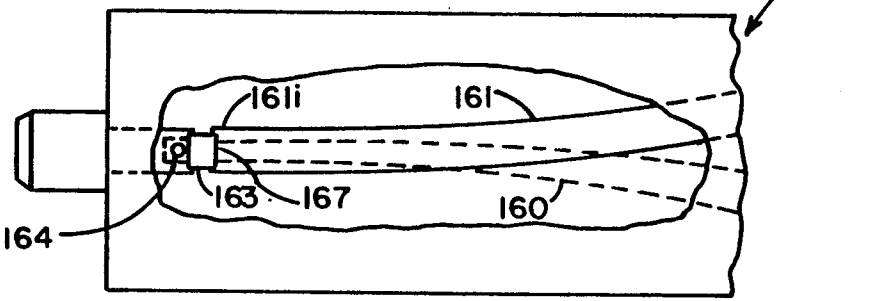
FIG. 35 is a view opposite the plan view of FIG. 32.
Figure 33:
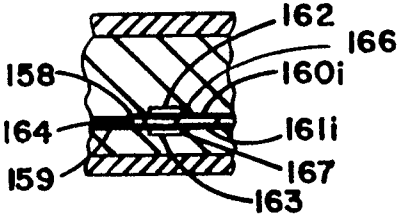
FIG. 33 is a cross section taken along line 33—33 of FIG. 32.
Figure 35:
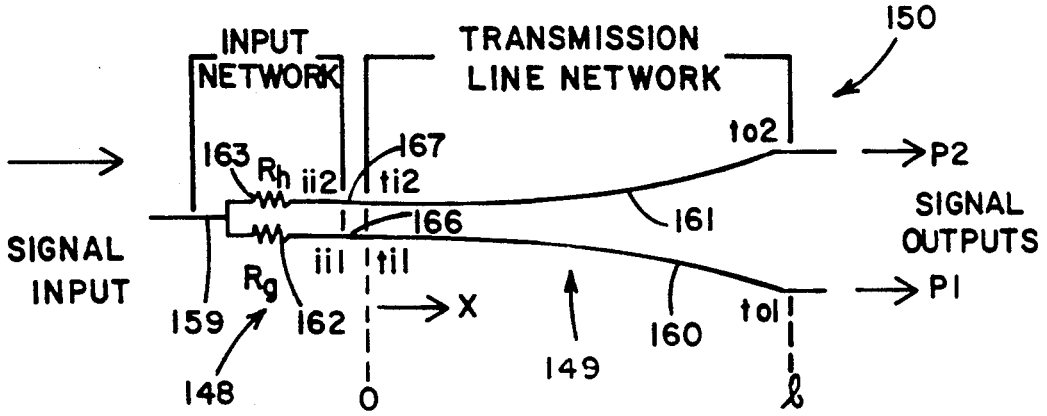

Substituting $Z_{e1}=118.39$ and $Z_{o1}=21.13$ in (76) gives a coupling coefficient of 0.605 between any two conductors of the first section.

l=10.0 mm gives a center frequency of 10.35 GHz, the frequency at which $\frac{1}{2}$ is one quarter wavelength. The values of $Z_{e1}$, $Z_{o1}$, $Z_{e2}$ and $Z_{o2}$ were calculated using the tables in the above-referenced paper by Young. A finite difference analysis approach similar to that described by Green in the paper "The numerical solution of some important transmission-line problems," *IEEE Transactions on Microwave Theory and Techniques*, vol. MTT-13, pp. 676–692, September 1965 was used to determine the values of r1, dc1, r2 and dc2 given below that correspond to these impedance values, r1=0.651 millimeters
dc1=0.956 millimeters
r2=1.138 millimeters
dc2=1.176 millimeters Equations (68)–(74) were used to calculate input VSWR, output VSWR and isolation and the results are plotted in FIGS. 29-31, respectively, for frequencies from 2.0–20.0 GHz. Substituting Rd=15.15 ohms in (75) gives a pass band insertion loss of 0.42 dB.

Two-Way Unequal-Division Power Divider

A third preferred embodiment of the present invention is shown in FIGS. 32-35. This embodiment is a 2-way unequal power divider 150. A schematic of this embodiment is shown in FIG. 36. This embodiment is similar to the first embodiment except the two series resistors have different values—providing for unequal power division. Power divider 150 comprises an outer conductor 151 which has a generally rectangular cross section and is filled with a lower dielectric sheet 152, a center dielectric sheet 153 and an upper dielectric sheet 154. The dielectric sheets are made of low loss material such as teflon or "duroid 5880".

Power divider 150 includes an input network 148 and a transmission line network 149. Network 148 includes connector 155, input conductors 158 and 159, resistors 162 and 163, and conductive element 164. Transmission line network 149 includes conductors 160 and 161, and connectors 156 and 157. The connections 166 and 167 between the resistors and transmission lines are also referred to as interconnection ports.

Conductors 158, 159, 160 and 161 are photo-etched from a conducting material (here copper) that has been deposited or laminated to both surfaces of the center dielectric sheet. Conductors 160 and 161 are spaced a maximum distance from each other at their outputs 160*o* and 161*o* and are in close proximity to each other at their inputs 160*i* and 161*i*. Conductive rectangle 158 is connected to input conductor 159 with conductive element 164 which is a plated through hole. "Chip" resistor 162 is connected between conductor 160*i* and rectangular contact 158. "Chip" resistor 163 is connected between conductor 161*i* and input conductor 159. For optimum high frequency operation it is important that conductive element 164 be located close to where resistors 162 and 163 connect to conductors 158 and 159. The input signal is applied to input connector 155 and unequally divided signals leave the power divider from output connectors 156 and 157. Resistor 162 has a larger resistance than resistor 163—and the output signal at 156 is less than the signal at 157.

Figure 37A:
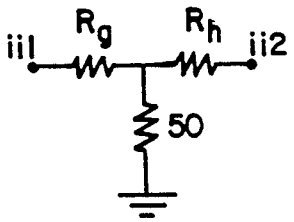
FIGS. 37*a*, 37*b* and 37*c* are networks representative of the embodiment of FIGS. 32-35.
Figure 37B:
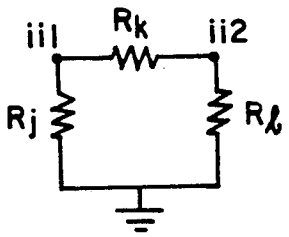
Figure 37C:
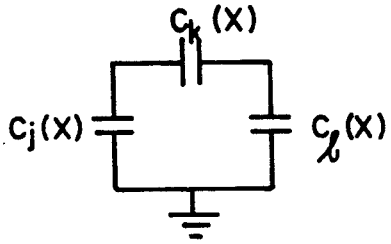

The network of FIG. 37*a* is seen looking toward the input at terminals ii1 and ii2. The network of FIG. 37*b* is equivalent to that of FIG. 37*a*. At any location x along the coupled lines the capacitances are as shown in FIG. 37*c*. We will refer to the normal mode impedances of the coupled lines at a location x as $Z_{c1}(x)$, $Z_{\pi 1}(x)$, $Z_{c2}(x)$ and $Z_{\pi 2}(x)$. From equations (36)–(38) and (41)–(44) it can be shown that $$Z_{c1}(0) = \frac{1}{G_{11} + G_{12}\sqrt{\frac{G_{11}}{G_{22}}}} \tag{77}$$

$$Z_{\pi 1}(0) = \frac{1}{G_{11} - G_{12}\sqrt{\frac{G_{11}}{G_{22}}}} \tag{78}$$

$$Z_{c2}(0) = \frac{G_{11}Z_{c1}(0)}{G_{22}} \tag{79}$$

$$Z_{\pi 2}(0) = \frac{G_{11}Z_{\pi 1}(0)}{G_{22}} \tag{80}$$

where $G_{11}$, $G_{12}$ and $G_{22}$ are elements of the conductance matrix [G] corresponding to the network of FIG. 37*b*.

As x varies from 0 to l, $Z_{c1}(x)$, $Z_{\pi 1}(x)$ and $Z_{c2}(x)$ are varied from $Z_{c1}(0)$, $Z_{\pi 1}(0)$ and $Z_{c2}(0)$ to 50 ohms according to Collin impedance transformer characteristics. $Z_{\pi 2}(x)$ is calculated from $$Z_{\pi 2}(x) = \frac{Z_{c2}(x)Z_{\pi 1}(x)}{Z_{c1}(x)} \tag{81}$$

In Table I are tabulated values of $R_j$, $R_k$, $R_l$, $Z_{c1}(0)$, $Z_{\pi 1}(0)$, $Z_{c2}(0)$, $Z_{\pi 2}(0)$ and pass band output signal power ratio P2/P1 for three combinations of $R_g$ and $R_h$.

TABLE I

| | CASE 1 | CASE 2 | CASE 3 |
|---|---|---|---|
| $R_g$ | 7.03 | 6.12 | 5.53 |
| $R_h$ | 17.32 | 27.32 | 52.17 |
| $R_j$ | 77.32 | 67.32 | 60.83 |
| $R_k$ | 26.78 | 36.78 | 63.47 |
| $R_l$ | 190.51 | 300.52 | 573.87 |
| $Z_{c1}(0)$ | 103.05 | 98.72 | 92.39 |
| $Z_{\pi 1}(0)$ | 11.01 | 13.52 | 18.67 |
| $Z_{c2}(0)$ | 121.64 | 136.01 | 169.99 |
| $Z_{\pi 2}(0)$ | 13.00 | 18.63 | 34.35 |
| P2/P1 | $\frac{2}{3}$ | $\frac{1}{2}$ | $\frac{1}{3}$ |
| P2/P1 (dB) | −1.76 | −3.01 | −4.76 |

Due to lack of symmetry this embodiment does not lend itself to a closed form of analysis. The analysis was made using a "brute force" approach. The transmission line network was divided into M (typically 500 or larger) constant impedance sections, each of length l/M. The normal mode impedances of each section were made equal to the values dictated by the Collin impedance transformers at the values of x at the midpoints of the sections. The ABCD matrix of each section was determined using equations (45)–(53). The resultant ABCD matrix for the transmission line network was then determined by taking the matrix product of the M sections. Electrical performance was then calculated using the resultant ABCD matrix.

In the pass band of the transmission line network it can be shown that the power divider insertion loss, due to power loss in resistors $R_g$ and $R_h$ is closely approximated by $$\text{Insertion Loss} = 10\log\left\{1 + \frac{R_gR_h}{50(R_g + R_h)}\right\} \tag{82}$$

It can also be shown that, as frequency increases, the pass band input VSWR approaches $$\text{Input } VSWR = 1 + \left\{\frac{R_gR_h}{25(R_g + R_h)}\right\} \tag{83}$$

The examples of Table I each give from (82) and (83) an insertion loss of 0.41 dB and an input VSWR that approaches 1.2.

From (4) and (40)–(42) it can be shown that the capacitive coupling coefficient $K_c$ between the two conductors at x=0 is given by $$K_c = \frac{C_k(0)}{\sqrt{C_f(0)C_f(0)}} = \frac{Z_{c1}(0) - Z_{\pi 1}(0)}{Z_{c1}(0) + Z_{\pi 1}(0)} \quad (84)$$

Figure 38:
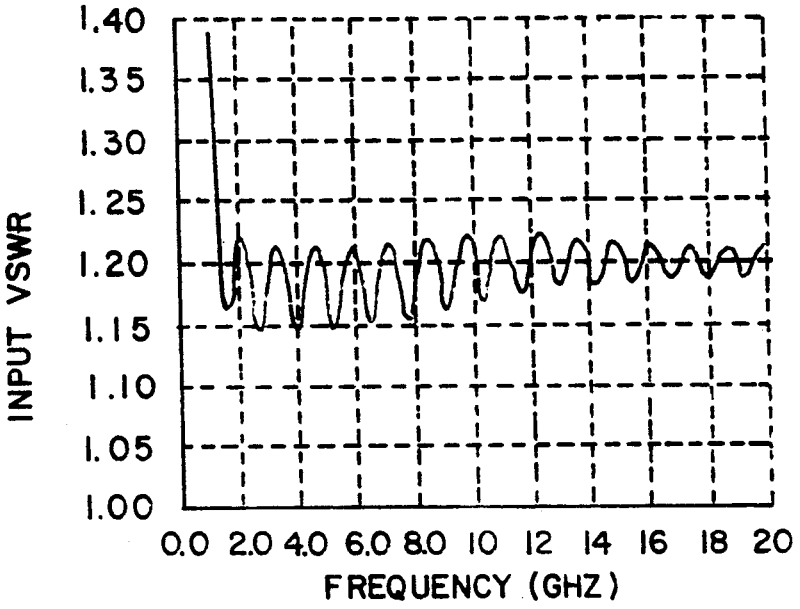
FIG. 38 is a plot of the calculated input VSWR as a function of frequency of the circuit of FIG. 36 with selected parameter values.
Figure 39:
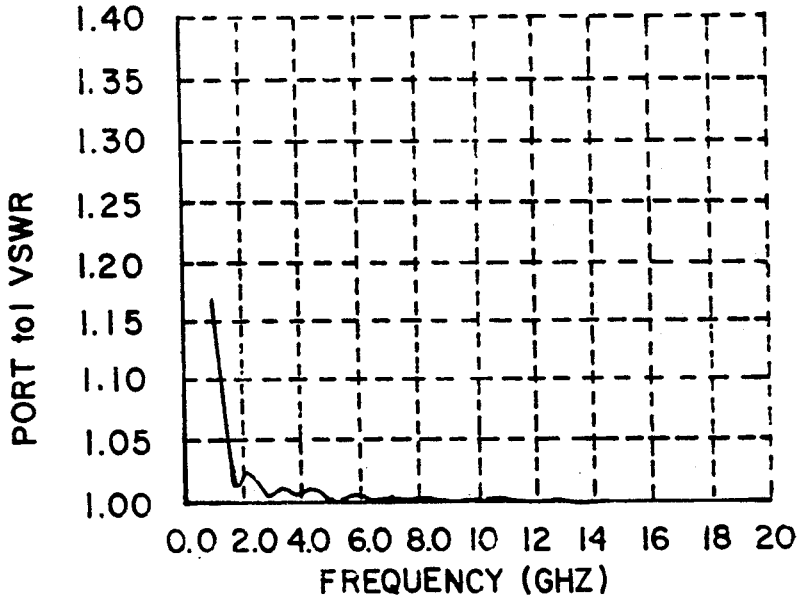
FIG. 39 is a plot of the calculated Port to 1 VSWR as a function of frequency of the circuit of FIG. 36 with selected parameter values.
Figure 40:
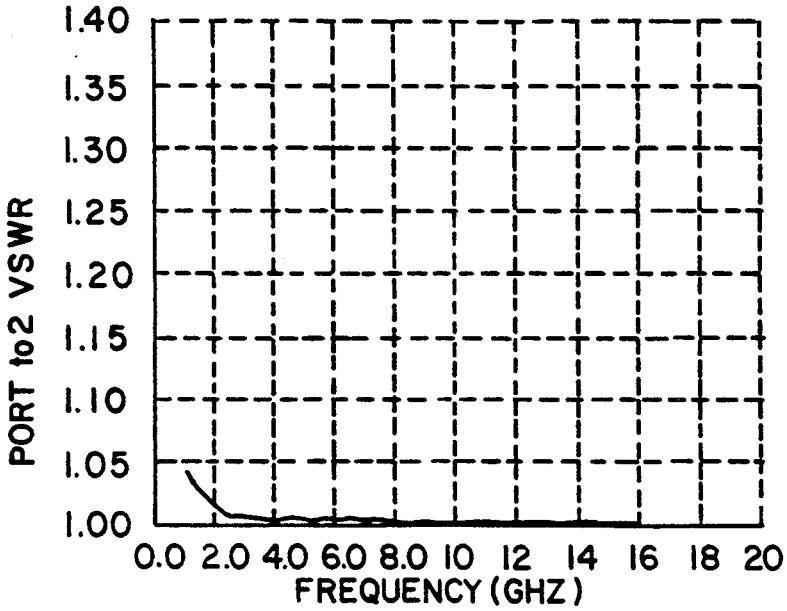
FIG. 40 is a plot of the calculated Port to 2 VSWR as a function of frequency of the circuit of FIG. 36 with selected parameter values.
Figure 41:
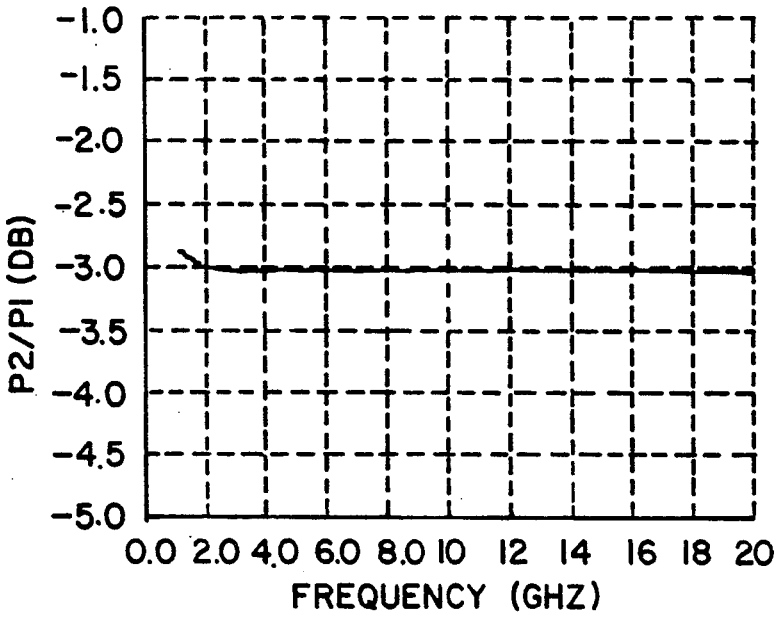
FIG. 41 is a plot of the calculated power ratio P2/P1 as a function of frequency of the circuit of FIG. 36 with selected parameter values.
Figure 42:
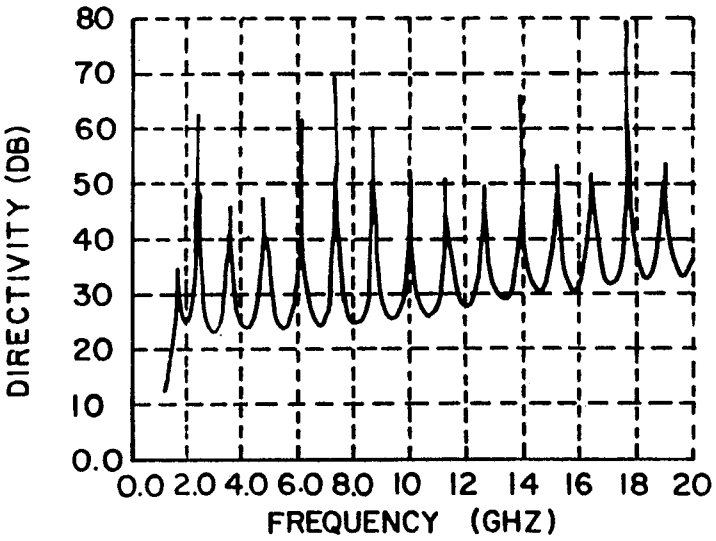
FIG. 42 is a plot of the calculated directivity as a function of frequency of the circuit of FIG. 36 with selected parameter values.

This type of power unequal power divider would in the industry probably be more commonly referred to as a directional coupler, or more specifically—a co-directional coupler since the coupled out signal P2 is in the same direction as the input signal. The device with $R_g=6.12$ ohms, and $R_h=27.32$ ohms would be called a directional coupler with a coupling vs. output of −3.0 dB. The values of P2/P1 shown in Table I would in general not be realizable with very broadband conventional TEM mode contra-directional couplers because the required coupling coefficient would be too high to be physically realizable in a practical structure. With an unequal power divider (or directional coupler) directivity is generally of more interest than isolation since it is a measure of how directional the device is. Electrical performance was calculated for an unequal power divider according to this third embodiment with the following parameters $l=80$ millimeters
$\epsilon_r=2.2$
$R_g=6.12$ ohms
$R_h=27.32$ ohms
$\rho_m=0.04$
$n=10$ Plots of input VSWR and output VSWR's of ports to1 and to2 are shown in FIGS. 38–40. Plots of P2/P1 and directivity are shown in FIGS. 41 and 42. Since the dielectric is homogeneous, the two output signals will be theoretically equal in phase. These curves show that this embodiment also has a high pass response. Substituting $Z_{c1}(O)=98.72$ and $Z_{\pi 1}(0)=13.52$ in (84) gives a capacitive coupling coefficient $K_c=0.759$ at $x=0$. In order to physically realize this embodiment it is necessary to determine at each x the strip line dimensions corresponding to the values of $Z_{c1}(x)$, $Z_{\pi 1}(x)$, and $Z_{c2}(x)$. This was done for a design with the above listed parameters, a bottom dielectric 0.813 mm thick, center dielectric 0.178 mm thick and top dielectric 2.794 mm thick—giving a ground plane spacing of 3.785 mm. These calculations were made using a computer program supplied with a commercially available software package by Djordjevic et al., "Matrix Parameters for Multi-Conductor Transmission Lines: Software and Users Manual," Aertech House, 1991. At the input of the transmission line network, conductor 161*i* is 1.651 mm wide and conductor 160*i* is 0.805 mm wide and centered above conductor 161*i*—to give $Z_{c1}(0)=98.72$, $Z_{\pi 1}(0)=13.52$ and $Z_{c2}(0)=136.01$. At the outputs of the transmission line network conductors 161*o* and 160*o* are of widths 1.991 mm and 2.311 mm, respectively, for 50 ohm impedance. Input conductor 159 is 1.991 mm wide for 50 ohms impedance.

Two-Way, Equal-Division, Limited-Bandwidth Power Divider

Figure 43:
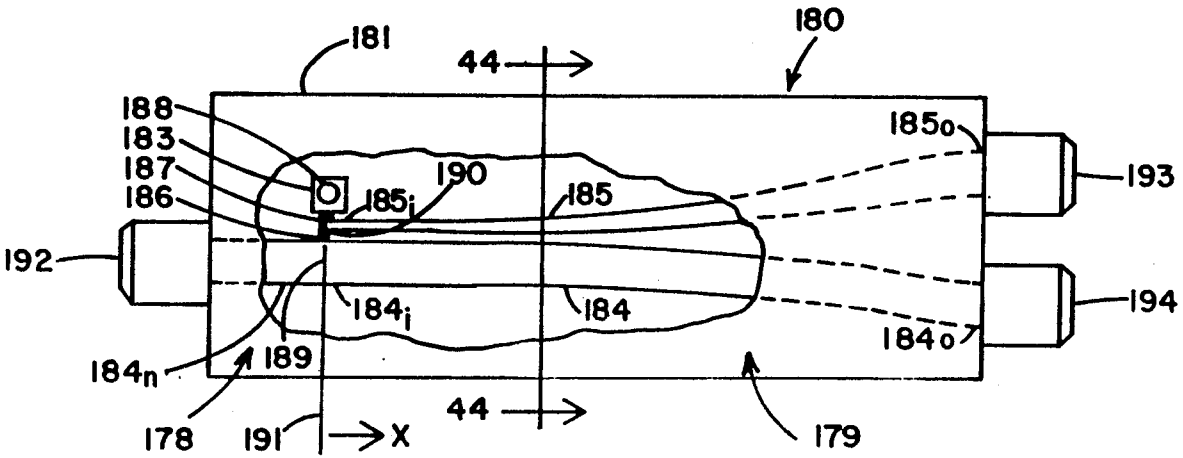
FIG. 43 is a plan view of a fourth preferred embodiment of the invention.
Figure 44:
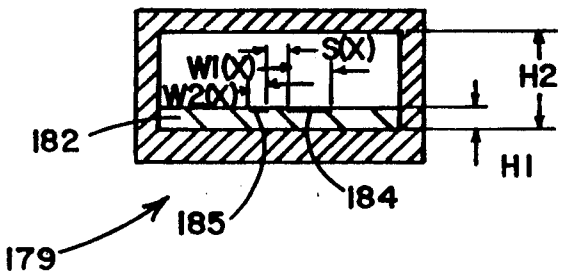
FIG. 44 is a cross section taken along line 44—44 of FIG. 43.
Figure 45:
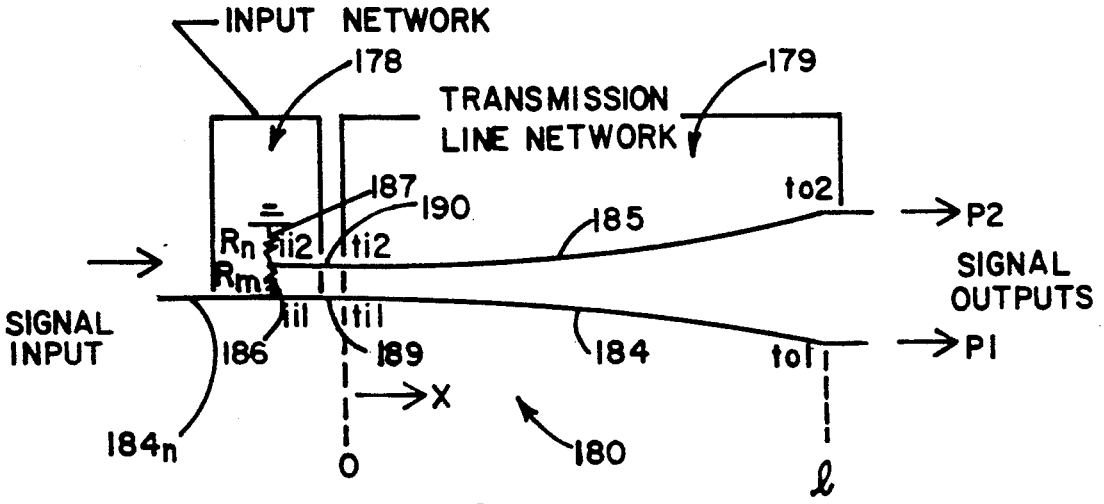
FIG. 45 is a schematic of the embodiment of FIGS. 43 and 44.

A fourth preferred embodiment of the present invention is shown in FIGS. 43 and 44. This embodiment is a 2-way equal division power divider that covers 24–42 GHz, a 55 percent bandwidth. A schematic of this embodiment is shown in FIG. 45. Power divider 180 comprises an outer conductor 181 which has a generally rectangular cross section of height H2. Positioned at the bottom of the rectangle is a substrate 182 of height H1 made of fused silica with a dielectric constant of 3.82. The dielectric above the substrate is air. Conductors 183, 184 and 185 are photo-etched from a conducting material (here 100 uinch gold) that has been deposited on the surface and the bottom of the substrate. This type of transmission line is typically referred to in the industry as microstrip. Conductors 184 and 185 are spaced a maximum distance from each other at their outputs 184*o* and 185*o* and are in close proximity to each other at their inputs 184*i* and 185*i*. Resistors 186 and 187 are photo-etched from a tantalum nitride resistive film that has been deposited on the substrate. Resistor 186 is connected between conductor 184*i* and conductor 185*i*. Resistor 187 is connected between conductor 185*i* and conductor 183. Rectangular contact 183 is connected by plated through hole 188 to the gold layer on the bottom of the substrate. For optimum high frequency operation it is important that plated through hole 188 be located close to where resistor 187 connects to conductive contact 183.

Power divider 180 includes an input network 178 and a transmission line network 179. Network 178 includes connector 192, an input portion 184*n* of conductor 184, resistors 186 and 187, conductive contact 183 and through hole 188. Interconnection ports 189 and 190 are represented simplistically by the intersection of line 191 through conductors 184 and 185. Network 179 includes conductors 184 and 185, as well as connectors 193 and 194 to which they are connected.

This embodiment is the most difficult to analyze theoretically, since the coupled lines are nonsymmetrical and the dielectric is inhomogeneous. An inhomogeneous dielectric is unsuitable for a very broadband divider in this configuration because the different propagation constants $\beta_c$ and $\beta_\pi$ (from (13) cause the output power ratio to vary with frequency. In this embodiment the difference in $\beta_c$ and $\beta_\pi$ is used to obtain much greater power transfer between the coupled lines from 24–42 GHz than could be achieved with a conventional edge coupled microstrip contra-directional coupler with similar spacing between the lines.

The previously referenced software package by Djordjevic et al. was again used to determine the normal mode parameters from microstrip transmission line dimensions. In the pass band of the transmission line network it can be shown that the power divider insertion loss, due to power loss in the resistors $R_m$ and $R_n$ is closely approximated by $$\text{Insertion Loss} = 10\log\left(1 + \frac{50}{R_m + R_n}\right) \quad (85)$$

It can also be shown that, as frequency increases, the input VSWR approaches $$\text{Input } VSWR = 1 + \frac{100}{R_m + R_n} \quad (86)$$

H1 and H2 were chosen to be 0.635 and 7.620 millimeters respectively. l was chosen to be 40 mm to give a center frequency of 33 GHz. The sum of $R_m$ and $R_n$ was chosen to be 500 ohms giving an insertion loss of 0.41 dB from (85) and input VSWR of 1.2 from (86). l, and $R_m$ and $R_n$ values of 325 and 175 ohms, respectively, were determined by iterating the analysis until the values of l, $R_m$ and $R_n$ used gave the 33 GHz center frequency and nearly equal power division across the band.

Figure 46:
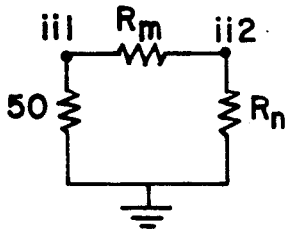
FIG. 46 is a network representative of the embodiment of FIGS. 43 and 44.

The network of FIG. 46 is seen looking toward the input at terminals ii1 and ii2. The software program by Djordjevic et al. was used to determine the values of W1(0), S(0), W2(0) and corresponding values of $R_c(0)$, $R_\pi(0)$, $Y_{c1}(0)$ and $Y_{\pi 1}(0)$ that give $G_{11}$, $G_{12}$ and $G_{22}$ from (21)–(23) that correspond to the elements of the conductance matrix [G] corresponding to FIG. 46. The values obtained were W1(0)=1.562 millimeters
S(0)=0.309 millimeters
W2(0)=0.176 millimeters
$R_c(0)=0.858$
$R_\pi(0)=-4.581$
$Y_{c1}(0)=0.0204$
$Y_{\pi 1}(0)=0.0372$

[L(0)] and [C(0)], the [L] and [C] matrices (defined in (1) and (2) of the coupled lines at x=0 were calculated to be $$[L(0)] = \begin{bmatrix} 2.620 \times 10^{-7} & 1.032 \times 10^{-7} \\ 1.032 \times 10^{-7} & 6.451 \times 10^{-7} \end{bmatrix}$$

$$[C(0)] = \begin{bmatrix} 1.309 \times 10^{-10} & 1.412 \times 10^{-11} \\ 1.412 \times 10^{-11} & 4.670 \times 10^{-11} \end{bmatrix}$$

Substituting values from the above matrices in (3) and (4) gives $K_L=0.251$ and $K_c=0.181$ at x=0.

W1(x), S(x) and W2(x) were chosen to vary according to $$W1(x)=W1(0)+(W1(L)-W1(0))(x/l)^2 \quad (87)$$

$$S(x)=S(0)+(2W1(L)-S(0))(x/l)^2 \quad (88)$$

$$W2(x)=W2(0)+(W2(L)-W2(0))(x/l)^2 \quad (89)$$

With W1(l)=W2(l)=1.392 mm to give $Z_{c1}=Z_{c2}=50$ ohms.

The widths of the lines from x=l to the outputs and from the input to x=0 were 1.361 mm to give 50 ohms characteristic impedance.

The "brute force" computer analysis was again used—dividing the transmission line network into N constant impedance sections. The normal mode parameters of each section corresponding to the values of W1(x), S(x) and W2(x) from (87)–(89) were substituted in (25)–(35) to determine the ABCD matrix of each section. The resultant ABCD matrix was then determined by taking the matrix product of the N sections. Electrical performance was then calculated using the resultant ABCD matrix.

Figure 47:
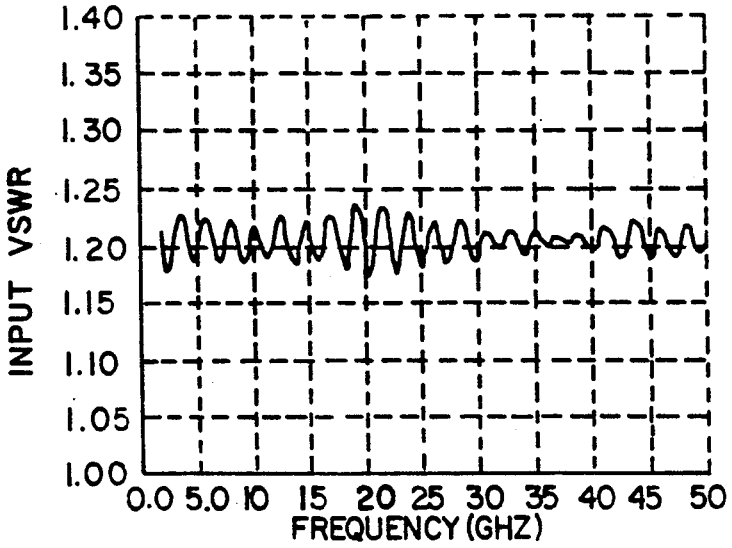
FIG. 47 is a plot of the calculated input VSWR as a function of frequency of the circuit of FIG. 45 with selected parameter values.
Figure 48:
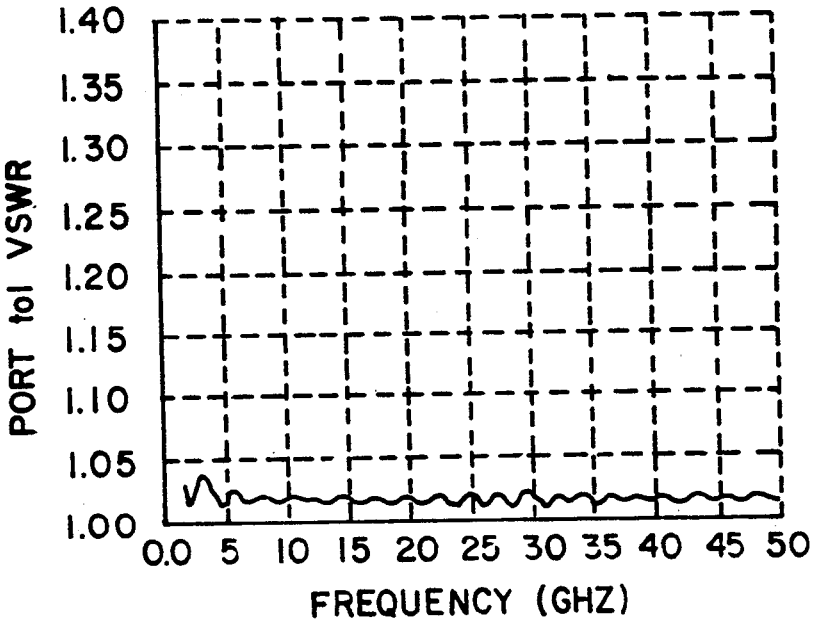
FIG. 48 is a plot of the calculated Port to 1 VSWR as a function of frequency of the circuit of FIG. 45 with selected parameter values.
Figure 49:
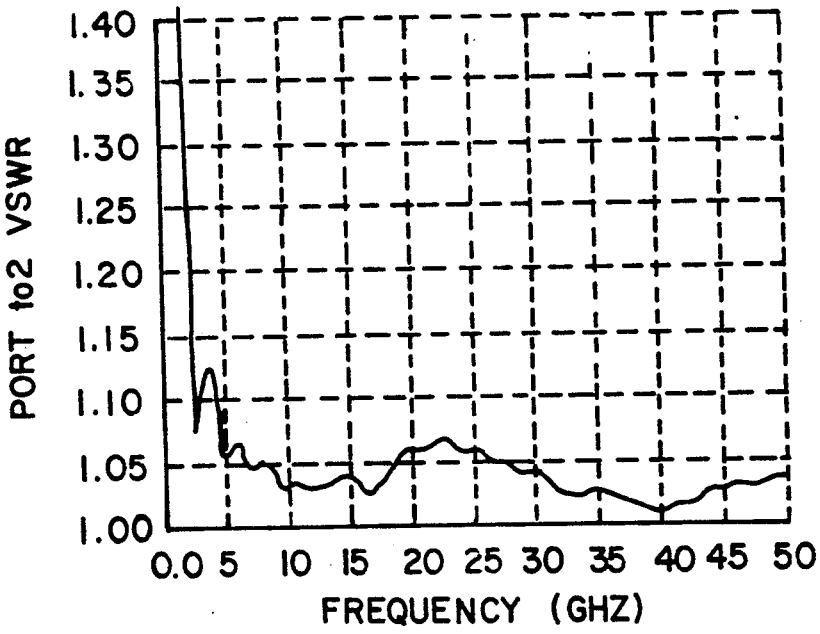
FIG. 49 is a plot of the calculated Port to2 VSWR as a function of frequency of the circuit of FIG. 45 with selected parameter values.
Figure 50:
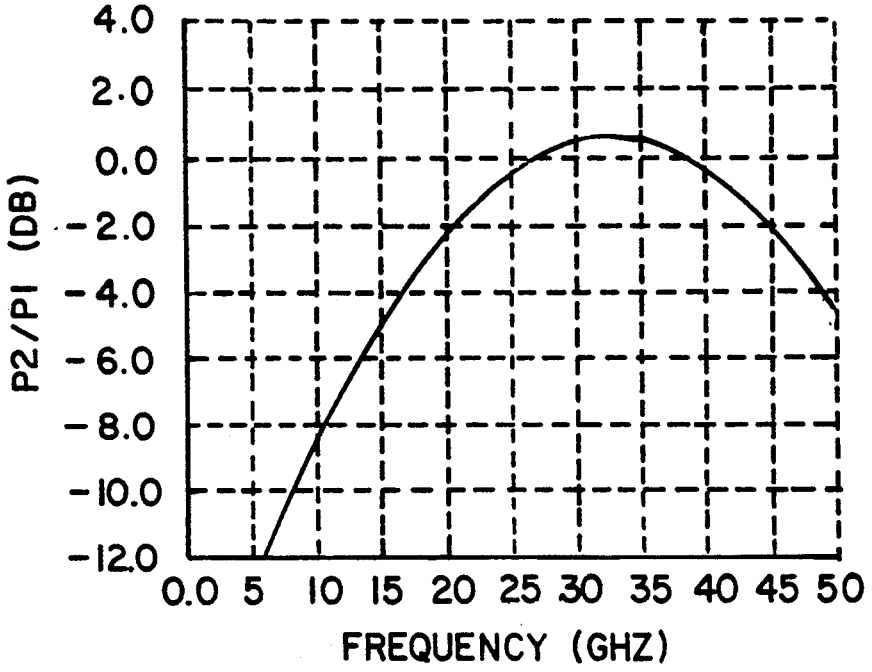
FIG. 50 is a plot of the calculated power ratio P2/P1 as a function of frequency of the circuit of FIG. 45 with selected parameter values.
Figure 51:
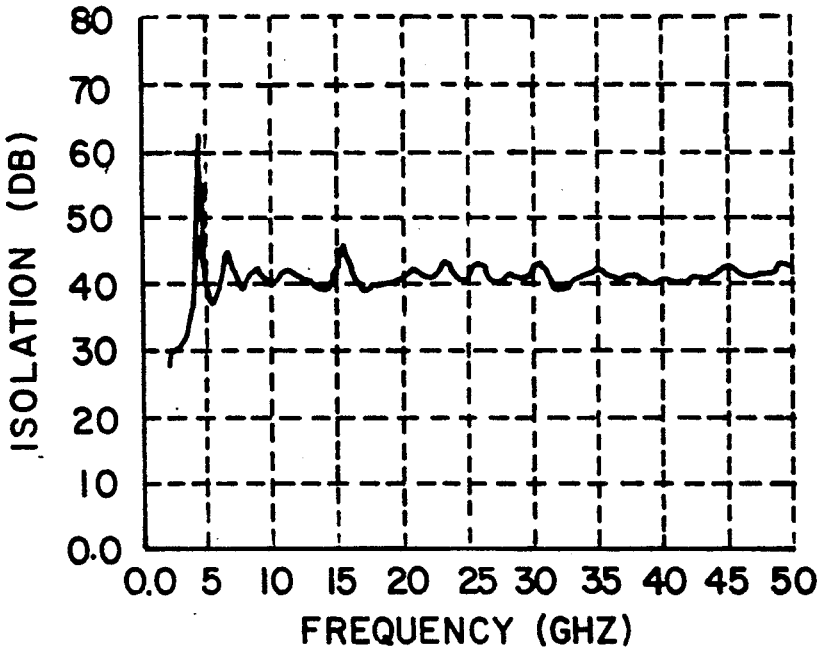
FIG. 51 is a plot of the calculated isolation as a function of frequency of the circuit of FIG. 45 with selected parameter values.
Figure 52:
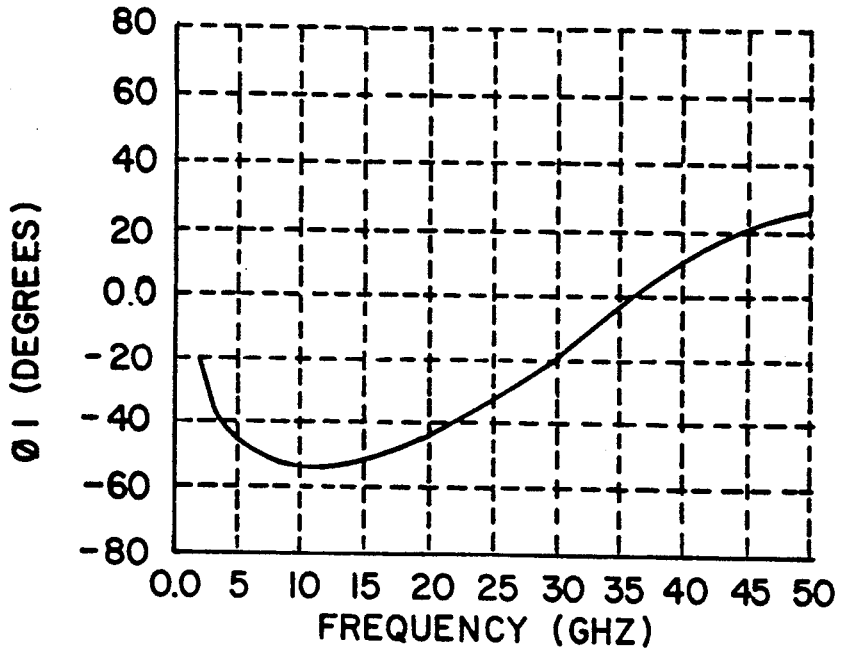
FIG. 52 is a plot of the calculated first phase difference as a function of frequency of the circuit of FIG. 45 with selected parameter values.

Plots of input VSWR and output VSWR's at ports to1 and to2 are shown in FIGS. 47–49. Plots of power ratio P2/P1 and isolation are shown in FIGS. 50 and 51. P2 and P1 track within 0.8 dB from 24–42 GHz. Unlike conventional contra-directional couplers, isolation stays high over a broad frequency range and has a highpass type of response. We will designate $\phi_1$ to be the difference in phase between the signal at port to2 and the signal at port to1. $\phi_1$ is plotted in FIG. 52. From 24–42 GHz $\phi_1$ varies from −35.2° to +16.4°. This variation suggests that the planar power divider of this embodiment would only be of interest when it was not required that the two outputs track in phase.

Figure 53:
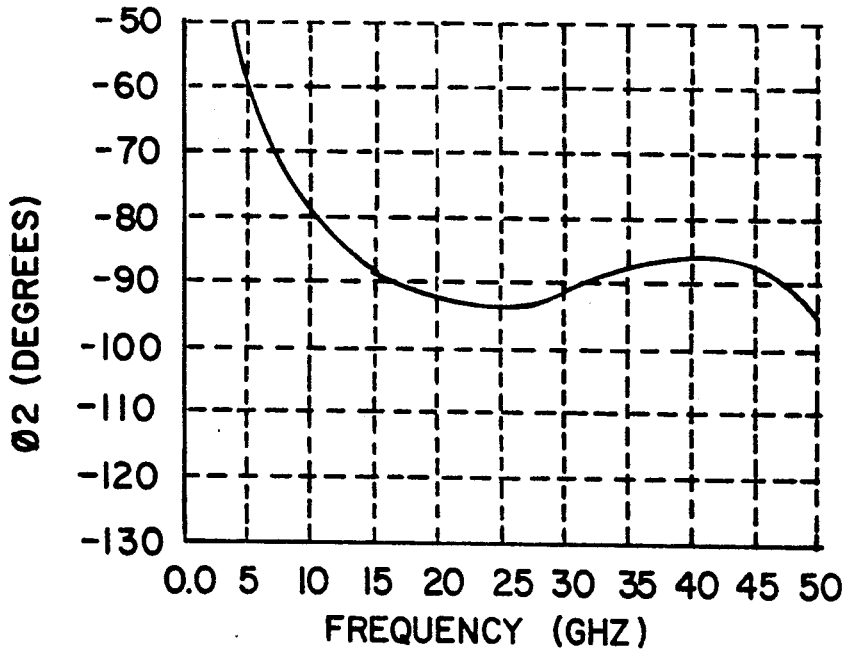
FIG. 53 is a plot of the calculated second phase difference as a function of frequency of the circuit of FIG. 45 with selected parameter values.

It is well known that a uniform section of transmission line introduces a negative phase shift that is proportional to frequency. By adding to port to2 a length of transmission line l2=1.186 mm that introduces a phase shift of −80.6° at 33 GHz the output signals can be made to 90° apart in phase. Let $\phi_2$ designate $\phi_1$ plus the phase shift introduced by line l2. $\phi_2$ is plotted in FIG. 53. From 24–42 GHz $\phi_2$ tracks −90° within ±4°.

In each embodiment discussed the choice was made to design the transmission line network to minimize output port VSWR's and maximize isolations between pairs of output ports. This choice results in a nominal input VSWR. The input VSWR could be reduced by redesigning the transmission line networks to lower input VSWR at the expense of introducing nominal output port VSWR's and lowering isolation between pairs of output ports. Modifying the transmission line networks in this manner would not change the principle of operation of the present invention.

In each embodiment discussed the choice was also made to use input and output port characteristic impedances of 50 ohms. It will be understood by those skilled in the art that the characteristic impedances of these ports may be different and other than 50 ohms.

The present invention can be practiced for N>3 as well. However, it is more difficult to make an N-way equal division power divider using a radially and angularly symmetric structure, as in the second preferred embodiment for N>3. For instance, for N=4, in order for an input network consisting of four equal value resistors (each connected between the input and an interconnection port) to terminate all signals from the transmission line network it is necessary that coupling at the input end between any two conductors be equal. In practical structures with a homogeneous dielectric, the coupling between opposite conductors will always be much less than that between adjacent conductors.

One way to equalize the coupling between conductors is to use two dielectrics, with one of the dielectrics having a significantly higher dielectric constant and located (radially) inside the four conductors. A structure that could be used would have conductors that are thin conductive strips. At the input end the structure has a cross section consisting of a high dielectric constant material inside a radius R1, a lower dielectric constant material between R1 and the circular outer conductor, and conductors that are arcs of circles with a radius R2 that is slightly larger than R1. Although this structure will not make coupling between any two conductors equal, it will make the couplings close enough for a practical design.

It will therefore be understood by those skilled in the art that variations may be made in the designs disclosed without varying from the spirit and scope of the invention. The designs disclosed are thus presented for purposes of illustration but not limitation. The scope of the invention is provided by the claim language and any modifications or interpretations thereof under the doctrine of equivalents.

I claim:

1. A microwave N-way power divider, where N is an integer greater than 1, comprising:

a transmission line network having N substantially uncoupled output ports, and N transmission lines, with each transmission line having an input end, and an output end connected to a corresponding one of said N output ports, said transmission lines being significantly coupled together at said input ends and providing a low reflection transformation from said output ports to said input ends; and an input network having an input port for receiving microwave frequency energy within a band of frequencies from a source, and N signal paths coupling said input port to said input ends of said N transmission lines, said input network including at least N−1 resistors, with each of said N−1 resistors having an end connected to a different one of said input ends of said transmission lines, and said input network providing a low reflection termination for all signals incident from said input ends of said transmission lines.

2. A power divider according to claim 1 wherein said N transmission lines have a homogeneous dielectric.

3. A power divider according to claim 1 wherein the cross section of said N transmission lines varies in a continuous manner from output ends to input ends.

4. A power divider according to claim 1 wherein said N transmission lines are spaced apart equally.

5. A power divider according to claim 1 wherein said at least N−1 resistors are in series between said input port and said input ends of said transmission lines.

6. A power divider according to claim 1 wherein said at least N−1 resistors have substantially equal resistances.

7. A power divider according to claim 1 wherein at least two of said at least N−1 resistors have different values.

8. A power divider according to claim 1 wherein said input network includes means for directly connecting said input port to said input end of one of said transmission lines.

9. A power divider according to claim 8 wherein N=2 and a resistor is in series between said input port and said input end of the other one of said transmission lines.

10. A power divider according to claim 9 wherein said input network includes a second resistor that couples said input end of the other of said transmission lines to a reference potential.

11. A power divider according to claim 9 wherein N=2 and said transmission lines are asymmetrical.

12. A power divider according to claim 1 wherein said input network includes N of said resistors.

13. A power divider according to claim 12 wherein each of said N resistors is in series between said input port and a respective input end of one of said transmission lines.

14. A power divider according to claim 13 wherein N=2 and the transmission lines are asymmetrical.

15. A microwave N-way power divider, where N is an integer greater than 1, consisting of:

a transmission line network consisting of N substantially uncoupled output ports, and N transmission lines, with each transmission line having an input end, and an output end connected to a corresponding one of said N output ports, said transmission lines being significantly coupled together at said input ends and providing a low reflection transformation from said output ports to said input ends; and an input network consisting of an input port for receiving microwave frequency energy within a band of frequencies from a source, and N signal paths coupling said input port to said input ends of said N transmission lines, with at least N−1 of said N signal paths each consisting of a resistor connected in series between said input port and a different one of said input ends of said transmission lines, said input network providing a low reflection termination for all signals incident from said N input ends of said transmission lines.

* * * * *